US007686167B1

(12) United States Patent
Stahl

(10) Patent No.: US 7,686,167 B1
(45) Date of Patent: Mar. 30, 2010

(54) STACKABLE CONTAINER WITH FRONT AND REAR WINDOWS, AND METHOD FOR USING THE SAME

(75) Inventor: Edward L. Stahl, Tyler, TX (US)

(73) Assignee: Orbis Canada Limited, Toronto, Ontario (CA)

( * ) Notice: Subject to any disclaimer, the term of this patent is extended or adjusted under 35 U.S.C. 154(b) by 0 days.

(21) Appl. No.: 11/610,933

(22) Filed: Dec. 14, 2006

(51) Int. Cl.
*B65D 21/02* (2006.01)
*B65D 85/62* (2006.01)

(52) U.S. Cl. ..... 206/507; 206/511; 206/509

(58) Field of Classification Search ..... 206/518, 206/515, 821; 220/DIG. 2, DIG. 15; D9/430, D9/414

See application file for complete search history.

(56) References Cited

U.S. PATENT DOCUMENTS 465,382 A * 12/1891 Marks ..... 206/512
1,207,279 A * 12/1916 Crum ..... 220/636
1,955,236 A * 4/1934 Jarvis ..... 206/512
2,026,204 A 12/1935 Andrews
2,029,746 A 2/1936 Tufts et al.
2,036,572 A * 4/1936 Frost ..... 229/406
2,061,414 A 11/1936 Tufts et al.
2,389,010 A 11/1945 Traumuller
2,442,723 A 6/1948 Economakis
2,457,841 A 1/1949 Smith et al.
2,457,842 A 1/1949 Smith et al.
2,641,383 A 6/1953 Coursey
3,219,232 A * 11/1965 Wilson ..... 206/507
3,219,400 A * 11/1965 Bergquist ..... 312/107
3,326,410 A * 6/1967 Asenbauer ..... 206/504
3,375,953 A 4/1968 Miller, Jr.
3,379,339 A 4/1968 Asenbauer
3,387,740 A 6/1968 Bockenstette
3,392,875 A 7/1968 Bockenstette
3,395,269 A * 7/1968 Klapes ..... 377/6
3,420,402 A 1/1969 Frater et al.

(Continued)

FOREIGN PATENT DOCUMENTS

CA 892971 2/1972

(Continued)

OTHER PUBLICATIONS

Mexican Foreign Associate Letter dated May 9, 2006 with Mexican Office Action issued in Mexican Appl. No. 2011009 dated Apr. 12, 2006 (5 pages).

(Continued)

*Primary Examiner*—Anthony Stashick
*Assistant Examiner*—Robert J Hicks
(74) *Attorney, Agent, or Firm*—Ungaretti & Harris

(57) ABSTRACT

A container for transporting and displaying baked products. The container can be stacked in a 0° and 180° stacking configuration, and when in the former, utilizes stacking feet projections to provide additional strength for carrying heavier products, and to substantially prevent lateral motion of the stacked containers. Further, the containers comprise curved stacking feet and stacking receptacles so that when containers are stacked in the 180° stacking configuration, they can be more easily removed. The containers further include substantially non-glossy, non-smooth areas that allow stickers to be more easily removed, and to reduce errors in counting containers by automated counting equipment.

19 Claims, 24 Drawing Sheets

U.S. PATENT DOCUMENTS

| | | | | | |
|---|---|---|---|---|---|
| 3,420,431 | A | * | 1/1969 | Donovan | 229/407 |
| 3,421,656 | A | | 1/1969 | Asenbauer | |
| 3,424,334 | A | * | 1/1969 | Goltz | 220/23.6 |
| 3,425,594 | A | * | 2/1969 | Bridenstine | 206/507 |
| 3,570,697 | A | | 3/1971 | Langston | |
| 3,659,743 | A | | 5/1972 | Box | |
| 3,675,815 | A | * | 7/1972 | Rehrig | 206/507 |
| 3,752,352 | A | | 8/1973 | Senecal | |
| 3,780,899 | A | * | 12/1973 | Roper | 220/4.04 |
| 3,780,906 | A | | 12/1973 | Herolzer | |
| 3,816,746 | A | * | 6/1974 | Gugliotta et al. | 250/223 R |
| D236,168 | S | | 7/1975 | Johnson | |
| 3,907,111 | A | | 9/1975 | Levenhagen | |
| 3,934,724 | A | | 1/1976 | Johnson | |
| 3,951,265 | A | | 4/1976 | Carroll | |
| 3,952,903 | A | | 4/1976 | Sanders et al. | |
| 3,993,211 | A | | 11/1976 | Astle | |
| 4,000,817 | A | | 1/1977 | Sanders et al. | |
| 4,093,070 | A | | 6/1978 | Stahl | |
| 4,093,071 | A | | 6/1978 | Stahl et al. | |
| 4,102,453 | A | | 7/1978 | Carroll et al. | |
| 4,105,117 | A | | 8/1978 | Atkin et al. | |
| 4,106,623 | A | | 8/1978 | Carroll et al. | |
| 4,106,624 | A | | 8/1978 | Thurman | |
| 4,106,625 | A | | 8/1978 | Carroll et al. | |
| 4,109,791 | A | | 8/1978 | Clipson et al. | |
| 4,189,052 | A | | 2/1980 | Carroll et al. | |
| 4,194,626 | A | | 3/1980 | Boller | |
| 4,211,327 | A | | 7/1980 | Stahl et al. | |
| 4,238,032 | A | * | 12/1980 | Thurman | 206/507 |
| D258,050 | S | | 1/1981 | Cornou | |
| 4,247,004 | A | | 1/1981 | Bird | |
| 4,316,154 | A | | 2/1982 | Krause | |
| 4,320,837 | A | | 3/1982 | Carroll et al. | |
| 4,383,611 | A | * | 5/1983 | Kreeger | 206/505 |
| 4,391,369 | A | | 7/1983 | Stahl et al. | |
| 4,423,813 | A | | 1/1984 | Kreeger et al. | |
| 4,426,001 | A | | 1/1984 | Stahl et al. | |
| 4,440,302 | A | | 4/1984 | Ehrman et al. | |
| 4,442,969 | A | * | 4/1984 | Holden | 229/407 |
| 4,457,433 | A | * | 7/1984 | Wilson | 206/505 |
| 4,466,541 | A | | 8/1984 | Tabler et al. | |
| 4,520,928 | A | | 6/1985 | Wilson | |
| 4,523,681 | A | | 6/1985 | Kreeger | |
| 4,573,577 | A | | 3/1986 | Miller | |
| 4,577,759 | A | | 3/1986 | Kreeger | |
| 4,600,103 | A | | 7/1986 | Tabler | |
| 4,601,393 | A | | 7/1986 | Veenman et al. | |
| RE32,223 | E | | 8/1986 | Kreeger et al. | |
| 4,619,366 | A | | 10/1986 | Kreeger | |
| 4,619,371 | A | | 10/1986 | Rehrig | |
| 4,643,310 | A | | 2/1987 | Deaton et al. | |
| 4,671,411 | A | | 6/1987 | Rehrig et al. | |
| D292,634 | S | | 11/1987 | Chabot | |
| 4,848,578 | A | | 7/1989 | Schafer | |
| 4,905,833 | A | | 3/1990 | Kreeger et al. | |
| 4,936,458 | A | | 6/1990 | Tabler et al. | |
| 4,960,207 | A | | 10/1990 | Tabler et al. | |
| 4,982,844 | A | | 1/1991 | Madan et al. | |
| 4,984,690 | A | * | 1/1991 | King et al. | 206/503 |
| 5,035,326 | A | | 7/1991 | Stahl | |
| D319,908 | S | | 9/1991 | Stahl | |
| D320,298 | S | | 9/1991 | Apps et al. | |
| 5,163,587 | A | | 11/1992 | Apps et al. | |
| D343,042 | S | | 1/1994 | Apps et al. | |
| 5,277,316 | A | * | 1/1994 | Apps et al. | 206/503 |
| D344,387 | S | | 2/1994 | Holliday | |
| 5,287,966 | A | | 2/1994 | Stahl | |
| D348,138 | S | | 6/1994 | Lang-Ree et al. | |
| D348,342 | S | | 6/1994 | Lang-Ree et al. | |
| D348,343 | S | | 6/1994 | Lang-Ree et al. | |
| D350,028 | S | | 8/1994 | Apps | |
| D350,437 | S | | 9/1994 | Apps et al. | |
| 5,344,021 | A | | 9/1994 | Rose | |
| 5,344,022 | A | | 9/1994 | Stahl | |
| 5,372,257 | A | | 12/1994 | Beauchamp et al. | |
| D354,167 | S | | 1/1995 | Stahl | |
| 5,377,858 | A | | 1/1995 | Morris, Sr. | |
| 5,415,293 | A | | 5/1995 | Ackermann et al. | |
| 5,469,986 | A | | 11/1995 | Jang | |
| 5,494,163 | A | | 2/1996 | Apps | |
| D374,555 | S | | 10/1996 | McMath | |
| 5,582,296 | A | | 12/1996 | Beauchamp et al. | |
| 5,609,254 | A | | 3/1997 | Loftus et al. | |
| D379,718 | S | | 6/1997 | Raghunathan | |
| D381,203 | S | | 7/1997 | Ackermann et al. | |
| D384,975 | S | | 10/1997 | Jackson | |
| 5,735,431 | A | | 4/1998 | LeTrudet | |
| 5,752,602 | A | | 5/1998 | Ackermann et al. | |
| 5,772,033 | A | | 6/1998 | Loftus et al. | |
| D398,448 | S | | 9/1998 | Zanni | |
| 5,816,406 | A | * | 10/1998 | Jupille et al. | 206/561 |
| D400,711 | S | | 11/1998 | Hwang | |
| D401,066 | S | | 11/1998 | Ackermann | |
| D401,412 | S | | 11/1998 | LeTrudet | |
| 5,860,527 | A | | 1/1999 | Frankenberg et al. | |
| 5,881,902 | A | | 3/1999 | Ackermann | |
| 5,896,987 | A | | 4/1999 | Bettenhausen | |
| 5,896,992 | A | * | 4/1999 | McGrath | 206/507 |
| 5,975,324 | A | | 11/1999 | Schmitt | |
| 5,992,673 | A | | 11/1999 | Hwang | |
| 6,015,056 | A | | 1/2000 | Overholt et al. | |
| D420,219 | S | | 2/2000 | Elvin-Jensen et al. | |
| 6,036,049 | A | | 3/2000 | Hwang | |
| D423,217 | S | | 4/2000 | Varfeldt | |
| D424,299 | S | | 5/2000 | Varfeldt | |
| 6,062,388 | A | * | 5/2000 | Ohayon | 206/509 |
| D429,565 | S | | 8/2000 | Aiken | |
| 6,098,827 | A | | 8/2000 | Overholt et al. | |
| 6,138,863 | A | | 10/2000 | Aiken | |
| 6,149,053 | A | * | 11/2000 | Chatterton et al. | 229/407 |
| D436,729 | S | | 1/2001 | Aiken | |
| D439,049 | S | | 3/2001 | Koefelda | |
| 6,209,742 | B1 | | 4/2001 | Overholt et al. | |
| 6,250,490 | B1 | | 6/2001 | Loftus | |
| 6,260,706 | B1 | | 7/2001 | Koefelda | |
| D446,017 | S | | 8/2001 | Koefelda | |
| D446,392 | S | | 8/2001 | Overholt et al. | |
| D446,939 | S | | 8/2001 | Koefelda | |
| 6,273,259 | B1 | | 8/2001 | Stahl | |
| 6,293,418 | B1 | | 9/2001 | Ogden et al. | |
| 6,308,858 | B1 | | 10/2001 | Koefelda | |
| D452,614 | S | | 1/2002 | Overholt | |
| 6,338,181 | B1 | | 1/2002 | Hwang | |
| 6,386,388 | B1 | | 5/2002 | Overholt | |
| 6,394,274 | B1 | | 5/2002 | Cheeseman | |
| D458,753 | S | | 6/2002 | Overholt et al. | |
| 6,398,054 | B1 | | 6/2002 | Overholt et al. | |
| 6,405,888 | B1 | | 6/2002 | Overholt et al. | |
| 6,409,041 | B1 | | 6/2002 | Overholt et al. | |
| D460,619 | S | | 7/2002 | Koefelda | |
| D463,667 | S | | 10/2002 | Hwang | |
| 6,460,717 | B1 | | 10/2002 | Smyers et al. | |
| D478,421 | S | | 8/2003 | Overholt et al. | |
| 6,601,724 | B1 | | 8/2003 | Koefelda et al. | |
| 6,607,199 | B2 | | 8/2003 | Gruber | |
| 6,631,822 | B1 | | 10/2003 | Overholt | |
| 6,843,386 | B2 | | 1/2005 | Raghunathan et al. | |
| 6,857,642 | B2 | | 2/2005 | Gruber | |
| 6,863,180 | B2 | | 3/2005 | Apps et al. | |
| 6,880,705 | B2 | | 4/2005 | Otting et al. | |
| 6,886,710 | B2 | | 5/2005 | Verna et al. | |
| 6,899,242 | B2 | | 5/2005 | Overholt et al. | |
| 6,918,502 | B1 | | 7/2005 | Overholt et al. | |

| | | | | |
|---|---|---|---|---|
| 6,918,508 | B2 | 7/2005 | Hwang | |
| 6,994,216 | B2 | 2/2006 | Wong | |
| 7,017,766 | B2 | 3/2006 | Hsu et al. | |
| 7,044,319 | B2 | 5/2006 | Overholt et al. | |
| 7,048,134 | B1 | 5/2006 | Hagan | |
| 7,048,135 | B2 | 5/2006 | Smyers et al. | |
| 7,059,489 | B2 | 6/2006 | Apps et al. | |
| 7,063,210 | B2 | 6/2006 | Smyers et al. | |
| 7,086,555 | B2 | 8/2006 | Overholt et al. | |
| 7,093,715 | B1 * | 8/2006 | Apps | 206/518 |
| 7,100,786 | B2 | 9/2006 | Smyers | |
| 7,104,414 | B2 | 9/2006 | Apps et al. | |
| 7,104,553 | B2 | 9/2006 | Gruber | |
| 7,128,231 | B2 | 10/2006 | Overholt | |
| 7,195,127 | B2 | 3/2007 | Hsu et al. | |
| 7,264,122 | B2 | 9/2007 | Koefelda et al. | |
| 2002/0056717 | A1 | 5/2002 | Hwang | |
| 2002/0130132 | A1 | 9/2002 | Overholt | |
| 2002/0148842 | A1 | 10/2002 | Overholt et al. | |
| 2002/0153682 | A1 | 10/2002 | Gruber | |
| 2002/0158067 | A1 | 10/2002 | Overholt et al. | |
| 2003/0015539 | A1 * | 1/2003 | Hayes et al. | 220/608 |
| 2003/0024845 | A1 | 2/2003 | Smyers et al. | |
| 2003/0042255 | A1 | 3/2003 | Smyers et al. | |
| 2003/0116564 | A1 | 6/2003 | Overholt et al. | |
| 2003/0132228 | A1 | 7/2003 | Apps et al. | |
| 2003/0155275 | A1 | 8/2003 | Apps et al. | |
| 2003/0183549 | A1 * | 10/2003 | Verna et al. | 206/509 |
| 2003/0222081 | A1 | 12/2003 | Apps et al. | |
| 2003/0230510 | A1 | 12/2003 | Aiken et al. | |
| 2004/0020821 | A1 | 2/2004 | Koefelda et al. | |
| 2004/0050742 | A1 | 3/2004 | Gruber | |
| 2004/0060844 | A1 | 4/2004 | Stahl | |
| 2004/0069780 | A1 | 4/2004 | Apps et al. | |
| 2004/0074801 | A1 * | 4/2004 | Ritter et al. | 206/509 |
| 2004/0099662 | A1 | 5/2004 | Overholt | |
| 2004/0104231 | A1 | 6/2004 | Hassell et al. | |
| 2004/0144680 | A1 | 7/2004 | Stahl | |
| 2004/0155048 | A1 | 8/2004 | Aiken | |
| 2004/0178197 | A1 | 9/2004 | Hsu et al. | |
| 2004/0182858 | A1 | 9/2004 | Smyers | |
| 2004/0188285 | A1 * | 9/2004 | Yoshikawa | 206/278 |
| 2004/0195139 | A1 | 10/2004 | Wong | |
| 2004/0226945 | A1 | 11/2004 | Hsu et al. | |
| 2005/0140107 | A1 | 6/2005 | Gruber | |
| 2005/0183980 | A1 | 8/2005 | Fernandez et al. | |
| 2006/0011627 | A1 | 1/2006 | Overholt et al. | |
| 2006/0070906 | A1 | 4/2006 | Verna | |
| 2006/0180491 | A1 | 8/2006 | Zephir et al. | |
| 2006/0186123 | A1 | 8/2006 | Baltz et al. | |
| 2006/0196800 | A1 | 9/2006 | Baltz | |
| 2006/0231555 | A1 | 10/2006 | Smyers et al. | |
| 2006/0237341 | A1 | 10/2006 | McDade | |
| 2007/0056874 | A1 | 3/2007 | Apps et al. | |
| 2007/0144931 | A1 | 6/2007 | McTavish et al. | |
| 2007/0175790 | A1 | 8/2007 | Fernandez et al. | |
| 2007/0187276 | A1 | 8/2007 | Stahl | |

FOREIGN PATENT DOCUMENTS

| | | | |
|---|---|---|---|
| CA | 1273881 | | 9/1990 |
| CA | 2032012 | | 6/1991 |
| CA | 2129617 | | 2/1995 |
| CA | 2130973 | | 3/1995 |
| CA | 2212239 | | 8/1996 |
| CA | 2484830 | | 8/1996 |
| CA | 2313137 | | 7/1999 |
| CA | 2326118 | | 5/2001 |
| CA | 2387491 | | 5/2001 |
| CA | 2389010 | | 5/2001 |
| CA | 2392265 | | 6/2001 |
| CA | 2395367 | | 7/2001 |
| CA | 2397522 | | 8/2001 |
| CA | 2406099 | | 10/2001 |
| CA | 2408247 | | 11/2001 |
| CA | 2384941 | | 1/2002 |
| CA | 2421595 | | 3/2002 |
| CA | 2426949 | | 5/2002 |
| CA | 2296895 | | 7/2002 |
| CA | 2367649 | | 7/2002 |
| CA | 2442723 | | 10/2002 |
| CA | 2455355 | | 2/2003 |
| CA | 2458773 | | 3/2003 |
| CA | 2472360 | | 7/2003 |
| CA | 2475531 | | 9/2003 |
| CA | 2485544 | | 12/2003 |
| CA | 2448920 | | 7/2004 |
| CA | 2431444 | | 12/2004 |
| EP | 370771 | | 5/1990 |
| FR | 1131652 | | 10/1956 |
| FR | 2678585 | | 1/1993 |
| GB | 2059920 | A * | 4/1981 |
| GB | 2067167 | | 7/1981 |
| GB | 2129401 | | 5/1984 |
| GB | 2137167 | | 10/1984 |
| GB | 2141778 | | 1/1985 |
| GB | 2171980 | | 9/1986 |
| GB | 2180821 | | 4/1987 |
| JP | 09239739 | A * | 9/1997 |
| TW | 338405 | | 8/1998 |
| TW | 372539 | | 10/1999 |
| WO | 0027716 | | 5/2000 |
| WO | 0066440 | | 11/2000 |
| WO | 0185558 | | 11/2001 |

OTHER PUBLICATIONS

Office Action dated Jan. 16, 2006, issued in Canadian Application No. 2,448,920 (2 pages).

Office Action dated Jun. 2, 2005, issued in EP Application No. 01 931 263.6-2308 (3 pages).

Office Action dated May 27, 2004, issued in EP Application No. 01 931 263.6-2308 (2 pages).

Canadian Official Action for Canadian Patent Application No. 2,431,444 dated Dec. 12, 2005 (2 pages).

Canadian Official Action for Canadian Patent Application No. 2,408,247 dated Nov. 24, 2005 (3 pages).

International Preliminary Examination Report dated Sep. 10, 2002, issued in PCT/CA01/00640 (11 pages).

* cited by examiner

STACKABLE CONTAINER WITH FRONT AND REAR WINDOWS, AND METHOD FOR USING THE SAME

BACKGROUND OF THE INVENTION

1. Field of the Invention

The invention relates to stackable containers. More particularly, the invention relates to a stackable container for use in delivering baked products, and a method for its use.

2. Background Art

The use of plastic containers for the storage and delivery of baked products is well known to those of ordinary skill in the art of the present invention. Such containers generally incorporate features such as a merchandising window, which allows consumers to obtain product stored in the container, even though there may be one or more similar containers stacked above the container with the product in it. Merchandising windows reduce the amount of labor expended by retailers because they do not have to continually remove empty containers to allow consumers access to product stored on other containers when several other containers are stacked in the retail stores. Other well known features included stacking in a 0° stacking configuration and a 180° stacking configuration. The 0° stacking configuration describes the configuration when a second, similar container is placed upon a lower container such that the front wall of the upper and lower container face the same direction. In the 180° stacking configuration, the front wall of the upper container is located above the rear wall of the lower container. Usually, the 180° stacking configurations increases the efficiency of stacking empty containers because when in the 180° stacking configuration, the upper container partially nests within the lower container, reducing the total height of the stacked containers.

As described, stacking containers in a 180° stacking configuration reduces the overall height of the stacked containers in regard to the 0° stacking configuration. Thus, retailers can place more of the stacked containers in less space for storage until the provider of the baked goods retrieves them to be filled at a warehouse or bakery. However, when the baked product manufacturer retrieves the empty containers stacked in the 180° stacking configuration, it is sometimes difficult to un-stack the empty containers. It is difficult to unstuck the empty containers because the stacking feet of the upper container that fit within receptacles in the lower containers tend to be difficult to extract from the receptacles. When there are hundreds of containers to unstack and move, increasing the ease of un-stacking can make a considerable difference in the time and effort required to unstack the containers, thereby saving money.

Further, known containers suffer from problems when fully loaded and stacked in 0° stacking configurations. Because containers are manufactured to tight size and weight tolerances, the amount of plastic used (in most cases, high density polyethylene (HDPE) is used to manufacture the containers) is reduced to an amount that sometimes is inadequate to fully support the weight of the baked products. When a container is fully loaded, bending of the base of the container can occur which can damage the container and more importantly the product located in a lower container.

Finally, as well known to those of skill in the art of the invention, certain retailers have increased their scope of operations and market share so that they can purchase hundreds, if not thousands, of packages of product from certain manufacturers. At the level of operation that these retailers operate under, they must pay particular attention to increasing efficiencies or they will easily lose the money they are saving by purchasing and selling baked product in bulk quantities. Therefore, certain of these retailers require that product identification stickers be placed on the containers so that machines can automatically record the product stored within the containers, and assist in loading the containers on carts for easier placement in the retail space. These stickers generally will use bar codes and/or other electronically readable indicia (e.g., RFID tags). When the containers are returned to the manufacturer (or their warehouse), the stickers must be removed. Unfortunately, known containers have extremely flat surfaces that make it very difficult to remove the stickers. Further, before or after the stickers are removed, other machines count the containers using photo-detection equipment. The photo-detection equipment uses a light beam, usually a low power level laser beam, to detect and count the containers as they move along conveyors. Known containers can cause mis-counts in the detection equipment as the high gloss surfaces associated with HDPE plastic used in the containers causes false readings.

Thus, a need exists for a container that overcomes the problems described above of difficulty in un-stacking in a 180 stacking configuration, bending, sticker removal, and false detections by automated counting equipment.

SUMMARY OF THE INVENTION

It is therefore a general object of the invention to provide a container that will obviate or minimize problems of the type previously described.

It is an object of the invention to provide a container that comprises curved stacking feet and matching stacking receptacles so that when stacked in a 180° stacking configuration the upper container can be substantially easily removed from the lower container whether unstacked from the front or rear of the upper container.

It is a further object of the invention to provide a container that comprises stacking feet with a projection that provides additional strength when stacking loaded containers in a 0° stacking configuration to substantially prevent bending of the base of the container, thereby substantially preventing damage to the containers and damage to product in the lower container, and also provides the benefit of substantially preventing side-to-side or lateral motion during transport or when product is being removed from the containers.

It is another object of the invention to provide a container that comprises non-glossy and non-smooth surfaces to allow stickers placed on the container to be more easily removed during a washing process. It is a further object of the invention to provide a container with substantially glossy-free areas to substantially prevent or reduce inaccurate readings of the number of containers detected by automated counting equipment.

All the above described disadvantages are overcome and a number of advantages are realized by a first aspect of the present invention that relates to a container for carrying product, wherein a second upper like container can be stacked in a 0° and a 180° stacking configuration on a first lower container, the containers comprising: a base; and a front wall, rear wall, left side wall, and right side wall, the walls substantially orthogonal and joined to each other, and substantially perpendicular to and joined to the base; wherein the right side wall includes a plurality of right side wall front stacking feet, and a plurality of right side wall rear stacking feet, wherein each right side wall front stacking foot includes a first curved surface on a rearward facing portion of said each front side wall front stacking foot, and further includes a first angled and second angled surface on a frontward facing portion of said each front side wall front stacking foot, and wherein each right side wall rear stacking foot includes a second curved surface on a frontward facing portion of said each right side wall rear stacking foot, and wherein, the left side wall includes a plurality of left side wall front stacking feet and a plurality of left side wall rear stacking feet, wherein each left side wall front stacking foot includes a third curved surface on a rearward facing portion of said each left side wall front stacking foot, and further includes a third and fourth angled surface on a frontward facing portion of said each left side wall front stacking foot, and wherein each left side wall rear stacking foot includes a fourth curved surface on a frontward facing portion of said each left side wall rear stacking foot, and wherein, the right side wall further includes a plurality of right side wall front 180° stacking receptacles and a plurality of right side wall rear 180° stacking receptacles, wherein each of the right side wall front 180° stacking receptacles includes a fifth curved surface, and each of the right side wall rear 180° stacking receptacles includes a sixth curved surface and a fifth and sixth angled surface, and the left side wall also includes a plurality of left side wall front 180° stacking receptacles and a plurality of left side wall rear 180° stacking receptacles, wherein each of the left side wall front 180° stacking receptacles includes a seventh curved surface, and each of the left side wall rear 180° stacking receptacles includes an eighth curved surface and a seventh and eighth angled surface, and further wherein, the right side wall front 180° stacking receptacle and the left side wall front 180° stacking receptacle of the first lower container are configured to accept the left side wall rear stacking foot and the right side wall rear stacking foot respectively of the second upper container, when the second upper container is stacked in a 180° stacking configuration with respect to a first lower container, and the right side wall rear 180° stacking receptacle and the left side wall rear 180° stacking receptacle of the first lower container are configured to accept the left side wall front stacking foot and the right side wall front stacking foot respectively of the second upper container, when the second upper container is stacked in a 180° stacking configuration with respect to a first lower container, and wherein, the first and second containers are configured such that when the second upper container is removed from the first lower container after being stacked in the 180° stacking configuration, the second curved surface of said right side wall rear stacking foot and the fourth curved surface of said left side wall rear stacking foot of the second upper container slidingly engages and rotates in a substantially smooth rotational manner with the substantially similarly seventh curved surface of said left side wall front 180° stacking receptacle and the substantially similarly fifth curved surface of said right side wall front 180° stacking receptacle of the first lower container, respectively, when the second upper container is lifted by its front wall, and the first curved surface of said right side wall front stacking foot and the third curved surface of said left side wall front stacking foot of the second upper container slidingly engages and rotates in a substantially smooth rotational manner with the substantially similarly eighth curved surface of said left side wall rear 180° stacking receptacle and the substantially similarly sixth curved surface of said right side wall rear 180° stacking receptacle of the first lower container, respectively, when the second upper container is lifted by its rear wall.

According to the first aspect of the present invention, the first, second, third, and fourth curved surfaces of the stacking feet of the left and right sidewalls comprise a plurality of angled surfaces such that the plurality of angled surface approximates that of a substantially smooth curved surface. Still further according to the first aspect of the present invention, each of the first, third, fifth and seventh angled surfaces comprise an angled surface formed at an angle between about 9° and about 11°, and further still, each of the first, third, fifth and seventh angled surfaces comprise an angled surface formed at an angle at about 10°.

According to the first aspect of the present invention, each of the second, fourth, sixth and eighth angled surfaces comprise an angled surface formed at an angle between about 3° and about 5°, and still further, each of the second, fourth, sixth and eighth angled surfaces comprise an angled surface formed at an angle at about 4°.

According to the first aspect of the present invention, the first and second containers are configured such that when the second upper container is removed from the first lower container after being stacked in the 180° stacking configuration, the first and second angled surfaces of said right side wall front stacking foot are configured to slidingly engage and rotate about the substantially similarly seventh and eighth angled surfaces of said left side wall rear 180° stacking receptacle, and the third and fourth angled surfaces of said left side wall front stacking foot are configured to slidingly engage and rotate about the substantially similarly fifth and sixth angled surfaces of said right side wall rear 180° stacking receptacle, when the second upper container is lifted by its rear wall.

According to a second aspect of the present invention, a container for carrying product is provided, wherein a second upper like container can be stacked in a 0° and a 180° stacking configuration on a first lower tray, the containers comprising: a base; and a front wall, rear wall, left side wall, and right side wall, the walls substantially orthogonal and joined to each other, and substantially perpendicular to and joined to the base, wherein the right side wall includes a plurality of right side wall front stacking feet, and a plurality of right side wall rear stacking feet, wherein each right side wall front stacking foot includes a first curved surface on a rearward facing portion of said each front side wall front stacking foot, and further includes a first angled and second angled surface on a frontward facing portion of said each front side wall front stacking foot, and wherein each right side wall rear stacking foot includes a second curved surface on a frontward facing portion of said each right side wall rear stacking foot, and wherein, the left side wall includes a plurality of left side wall front stacking feet and a plurality of left side wall rear stacking feet, wherein each left side wall front stacking foot includes a third curved surface on a rearward facing portion of said each left side wall front stacking foot, and further includes a third and fourth angled surface on a frontward facing portion of said each left side wall front stacking foot, and wherein each left side wall rear stacking foot includes a fourth curved surface on a frontward facing portion of said each left side wall rear stacking foot, and wherein, the right side wall further includes a plurality of right side wall front 180° stacking receptacles and a plurality of right side wall rear 180° stacking receptacles, wherein each of the right side wall front 180° stacking receptacles includes, a fifth curved surface, and each of the right side wall rear 180° stacking receptacles includes, a sixth curved surface and a fifth and sixth angled surface, and the left side wall also includes a plurality of left side wall front 180° stacking receptacles and a plurality of left side wall rear 180° stacking receptacles, wherein each of the left side wall front 180° stacking receptacles includes, a seventh curved surface, and each of the left side wall rear 180° stacking receptacles includes, a eighth curved surface and a seventh and eighth angled surface, and further wherein, the right side wall front 180° stacking receptacle and the left side wall front 180° stacking receptacle of the first lower container are configured to accept the left side wall rear stacking foot and the right side wall rear stacking foot respectively of the second upper container, when the second upper container is stacked in a 180° stacking configuration with respect to a first lower container, and the right side wall rear 180° stacking receptacle and the left side wall rear 180° stacking receptacle of the first lower container are configured to accept the left side wall front stacking foot and the right side wall front stacking foot respectively of the second upper container, when the second upper container is stacked in a 180 stacking configuration with respect to a first lower container, and wherein, the first and second containers are configured such that when the second upper container is removed from the first lower container after being stacked in the 180° stacking configuration, the first and second angled surfaces of said right side wall front stacking foot are configured to slidingly engage and rotate about the substantially similarly seventh and eighth angled surfaces of said left side wall rear 180° stacking receptacle, and the third and fourth angled surfaces of said left side wall front stacking foot are configured to slidingly engage and rotate about the substantially similarly fifth and sixth angled surfaces of said right side wall rear 180° stacking receptacle, when the second upper container is lifted by its rear wall.

According to the second aspect of the present invention, each of the first, second, third, and fourth curved surfaces of the stacking feet of the left and right sidewalls comprise a plurality of angled surfaces such that the plurality of angled surface approximates that of a substantially smooth curved surface. Still further according to the second aspect of the present invention, each of the first, third, fifth and seventh angled surfaces comprise an angled surface formed at an angle between about 9° and about 11°. According to the second aspect of the present invention, each of the first, third, fifth and seventh angled surface comprises an angled surface formed at an angle at about 10°.

According to the second aspect of the present invention, each of the second, fourth, sixth and eighth angled surfaces comprises an angled surface formed at an angle between about 3° and about 5°, and still further according to the second aspect, each of the second, fourth, sixth and eighth surfaces comprises an angled surface formed at an angle at about 4°.

According to the second aspect of the present invention, the first and second containers are configured such that when the second upper container is removed from the first lower container after being stacked in the 180° stacking configuration, the second curved surface of said right side wall rear stacking foot and the fourth curved surface of said left side wall rear stacking foot of the second upper container slidingly engages and rotates in a substantially smooth rotational manner with the substantially similarly seventh curved surface of said left side wall front 180° stacking receptacle and the substantially similarly fifth curved surface of said right side wall front 180° stacking receptacle of the first lower container, respectively, when the second upper container is lifted by its front wall, and the first curved surface of said right side wall front stacking foot and the third curved surface of said left side wall front stacking foot of the second upper container slidingly engages and rotates in a substantially smooth rotational manner with the substantially similarly eighth curved surface of said left side wall rear 180° stacking receptacle and the substantially similarly sixth curved surface of said right side wall rear 180° stacking receptacle of the first lower container, respectively, when the second upper container is lifted by its rear wall.

According to a third aspect of the present invention, a container is provided comprising: a base; a front wall including (i) a front wall interior surface, (ii) a front wall exterior surface, and (iii) left and right inner channels located inward from the left and right side walls respectively; a rear wall including (i) a rear wall interior surface, (ii) a rear wall exterior surface, and (iii) left and right inner channels located inward from the left and right side walls respectively; and a pair of opposing left and right side walls, each of the pair of opposing left and right side walls including (i) a side wall top portion, (ii) a side wall interior surface, (iii) a side wall exterior surface, (iv) an outer rail located on the side wall top portion, (v) an outer channel located on the side wall top portion and adjacent to, and inward from, the outer rail, (vi) front and rear stacking feet, wherein each of the rear stacking feet further includes a projection projecting outwardly from the rear stacking feet at a lower portion thereof, and (vii) a lower rail, wherein, the container is configured such that, when a substantially similar second upper container is placed on top of a first lower container such that the front wall of the first lower container and the front wall of the second upper container face in the same direction, and the second upper container slides backwards with respect to the first lower container, or the first lower container slides frontwards with respect to the second upper container, the projection on the rear stacking feet of both the left and right side walls of the second upper container is configured to support the second upper container on the outer rails of the left and right side walls of the first lower container, and the lower rails of the left and right side walls of the second upper container are configured to slidingly engage within the left and right inner channels of the first lower container, thereby substantially preventing any lateral movement of the second upper container with respect to the first lower container and to support the weight of the second upper containers on the first lower container.

According to the third aspect of the present invention, the container further comprises a left side wall outer rail indent portion; and a right side wall outer rail indent portion, wherein, the left side wall outer rail indent portion is configured to receive and secure a lower surface portion of the left rear stacking foot, and the right side wall outer rail indent portion is configured to receive and secure a lower surface portion of the right rear stacking foot, such that either or both the left side wall outer rail indent portion and the right side wall outer rail indent portion substantially prevents or inhibits frontwards, backwards, and/or lateral motion of an upper stacked container.

According to the third aspect of the present invention, the container further comprises a right side wall top inner rail; a left side wall top inner rail; a right side wall front stacking foot wall portion located at a bottommost portion of the right side wall front stacking foot; a right side wall rear stacking foot wall portion located at a bottommost portion of the right side wall front stacking foot; a left side wall front stacking foot wall portion located at a bottommost portion of the right side wall front stacking foot; a left side wall rear stacking foot wall portion located at a bottommost portion of the right side wall front stacking foot; a right side wall front stacking foot channel formed between the right side wall front stacking foot wall portion and the right side wall; a right side wall rear stacking foot channel formed between the right side wall rear stacking foot wall portion and the right side wall; a left side wall front stacking foot channel formed between the left side wall front stacking foot wall portion and the left side wall; and a left side wall rear stacking foot channel formed between the left side wall rear stacking foot wall portion and the left side wall, wherein, when an upper container is stacked on a lower container in a 0° stacking configuration, the left side wall front stacking foot channel and the left side wall rear stacking foot channel, and the right side wall front stacking foot channel and the right side wall rear stacking foot channel are configured to substantially smoothly engage the left side wall top inner rail and right side wall top inner rail, respectively, such that the upper container slides substantially smoothly and freely frontwardly and backwardly over the lower container, and when the upper container is stacked on a lower container in a 180° stacking configuration, the left side wall front stacking foot channel and the left side wall rear stacking foot channel, and the right side wall front stacking foot channel and the right side wall rear stacking foot channel are configured to substantially smoothly engage the right side wall top inner rail and left side wall top inner rail, respectively, such that the upper container slides substantially smoothly and freely frontwardly and backwardly over the lower container.

According to a fourth aspect of the present invention, a container is provided comprising: a base; a front wall including (i) a front wall interior surface, (ii) a front wall exterior surface, and (iii) a first substantially glossy free area located on the front wall exterior surface; a rear wall including (i) a rear wall interior surface, (ii) a rear wall exterior surface, and (iii) a second substantially glossy free area located in the rear wall exterior surface; and a pair of opposing left and right side walls, each of the pair of opposing left and right side walls including (i) a side wall top portion, (ii) a side wall interior surface, (iii) a side wall exterior surface, and (iv) third and fourth substantially glossy free areas on the left and right side walls configured to substantially prevent a counting machine from mistakenly counting a container more than once when the container is placed under observation of the counting machine. According to the fourth aspect of the present invention, each of the first, second, third and fourth substantially glossy free areas comprise one or more of a plurality of micro-bumps, diamond etching, recesses, ribs, grooves, and various other types of markings, indentations and other alterations of the surfaces each of the respective front, rear, left side, and rear side walls.

According to a fifth aspect of the present invention, a container is provided comprising a base; a front wall including (i) a front wall interior surface, (ii) a front wall exterior surface, and (iii) a first substantially glossy free area located on the front wall exterior surface; a rear wall including (i) a rear wall interior surface, (ii) a rear wall exterior surface, and (iii) a second substantially glossy free area located in the rear wall exterior surface; and a pair of opposing left and right side walls, each of the pair of opposing left and right side walls comprising (i) a side wall top portion, (ii) a side wall interior surface, (iii) a side wall exterior surface, and (iv) third and fourth substantially glossy free areas on the left and right side walls configured to disperse an optical signal transmitted by the counting machine thereby substantially preventing the counting machine from counting the containers more than once. According to the fifth aspect of the present invention, each of the first, second, third and fourth substantially glossy free areas comprise one or more of a plurality of micro-bumps, diamond etching, recesses, ribs, grooves, and various other types of markings, indentations and other alterations of the surfaces each of the respective front, rear, left side, and rear side walls.

According to a sixth aspect of the present invention, a container for carrying product is provided, wherein a second upper like container can be stacked in a 0° and a 180° stacking configuration on a first lower tray, the containers comprising: a base; and a front wall, rear wall, left side wall, and right side wall, the walls substantially orthogonal and joined to each other, and substantially perpendicular to and joined to the base, wherein, the front wall includes (i) a front wall interior surface, (ii) a front wall exterior surface, and (iii) left and right inner channels located inward from the left and right side walls respectively, and wherein the rear wall includes (i) a rear wall interior surface, (ii) a rear wall exterior surface, and (iii) left and right inner channels located inward from the left and right side walls respectively, the right side wall includes a plurality of right side wall front stacking feet, a plurality of right side wall rear stacking feet, a right side wall top portion, a right side wall outer rail located on the right side wall top portion, a right side wall outer channel located on the right side wall top portion and adjacent to, and inward from, the right side wall outer rail, a right side wall lower rail, wherein each right side wall front stacking foot includes a first curved surface on a rearward facing portion of said each front side wall front stacking foot, and further includes a first angled and second angled surface on a frontward facing portion of said each front side wall front stacking foot, and wherein each right side wall rear stacking foot includes a second curved surface on a frontward facing portion of said each right side wall rear stacking foot, a right side wall rear stacking foot projection projecting outwardly from the right side wall rear stacking foot at a lower portion thereof, and wherein, the left side wall includes a plurality of left side wall front stacking feet, a plurality of left side wall rear stacking feet, a left side wall top portion, a left side wall outer rail located on the left side wall top portion, a left side wall outer channel located on the left side wall top portion and adjacent to, and inward from, the left side wall outer rail, and a left side wall lower rail, wherein each left side wall front stacking foot includes a third curved surface on a rearward facing portion of said each left side wall front stacking foot, and further including a third and fourth angled surface on a frontward facing portion of said each left side wall front stacking foot, and wherein each left side wall rear stacking foot includes a fourth curved surface on a frontward facing portion of said each left side wall rear stacking foot, a left side wall rear stacking foot projection projecting outwardly from the left side wall rear stacking foot at a lower portion thereof, and wherein, the right side wall further includes a plurality of right side wall front 180° stacking receptacles and a plurality of right side wall rear 180° stacking receptacles, wherein each of the right side wall front 180° stacking receptacles includes a fifth curved surface, and each of the right side wall rear 180° stacking receptacles includes a sixth curved surface and a fifth and sixth angled surface, and the left side wall also includes a plurality of left side wall front 180° stacking receptacles and a plurality of left side wall rear 180° stacking receptacles, wherein each of the left side wall front 180° stacking receptacles includes a seventh curved surface, and each of the left side wall rear 180° stacking receptacles includes an eighth curved surface and a seventh and eighth angled surface, and further wherein the right side wall front 180° stacking receptacle and the left side wall front 180° stacking receptacle of the first lower container are configured to accept the left side wall rear stacking foot and the right side wall rear stacking foot respectively of the second upper container, when the second upper container is stacked in a 180° stacking configuration with respect to a first lower container, and the right side wall rear 180° stacking receptacle and the left side wall rear 180° stacking receptacle of the first lower container are configured to accept the left side wall front stacking foot and the right side wall front stacking foot respectively of the second upper container when the second upper container is stacked in a 180° stacking configuration with respect to a first lower container, and wherein, the first and second containers are configured such that when the second upper container is removed from the first lower container after being stacked in the 180° stacking configuration, the second curved surface of said right side wall rear stacking foot and the fourth curved surface of said left side wall rear stacking foot of the second upper container slidingly engages and rotates in a substantially smooth rotational manner with the substantially similarly seventh curved surface of said left side wall front 180° stacking receptacle and the substantially similarly fifth curved surface of said right side wall front 180° stacking receptacle of the first lower container, respectively, when the second upper container is lifted by its front wall, and the first curved surface of said right side wall front stacking foot and the third curved surface of said left side wall front stacking foot of the second upper container slidingly engages and rotates in a substantially smooth rotational manner with the substantially similarly eighth curved surface of said left side wall rear 180° stacking receptacle and the substantially similarly sixth curved surface of said right side wall rear 180° stacking receptacle of the first lower container, respectively, when the second upper container is lifted by its rear wall, and further wherein, the first and second containers are configured such that when the second upper container is removed from the first lower container after being stacked in the 180° stacking configuration, the first and second angled surfaces of said right side wall front stacking foot are configured to slidingly engage and rotate about the substantially similarly seventh and eighth angled surfaces of said left side wall rear 180° stacking receptacle, and the third and fourth angled surfaces of said left side wall front stacking foot are configured to slidingly engage and rotate about the substantially similarly fifth and sixth angled surfaces of said right side wall rear 180° stacking receptacle when the second upper container is lifted by its rear wall, and further wherein, the container is configured such that when a substantially similar second upper container is placed on top of a first lower container such that the front wall of the first lower container and the front wall of the second upper container face in the same direction, and the second upper container slides backwards with respect to the first lower container, or the first lower container slides frontwards with respect to the second upper container, the projection on the rear stacking feet of both the left and right side walls of the second upper container is configured to support the second upper container on the outer rails of the left and right side walls of the first lower container, and the lower rails of the left and right side walls of the second upper container are configured to slidingly engage within the left and right inner channels of the first lower container, thereby substantially preventing any lateral movement of the second upper container with respect to the first lower container and to support the weight of the second upper containers on the first lower container, and still further wherein the front wall further includes a first substantially glossy free area located on the front wall exterior surface, the rear wall includes a second substantially glossy free area on the rear wall exterior surface, and the left and right side walls further include a third and fourth substantially glossy free areas on the left and right side walls configured to substantially prevent a counting machine from mistakenly counting a container more than once when the container is placed under observation of the counting machine and the third and fourth substantially glossy free areas on the left and right side walls further configured to disperse an optical signal transmitted by the counting machine thereby substantially preventing the counting machine from mistakenly counting a container more than once when the container is placed under observation of the counting machine.

According to the sixth aspect of the present invention, each of the first, second, third and fourth substantially glossy free areas comprise one or more of a plurality of micro-bumps, recesses, diamond etchings, ribs, grooves, and various other types of markings, indentations and other alterations of the surfaces each of the respective front, rear, left side, and rear side walls.

According to a seventh aspect of the present invention, a method of stacking and unstacking similar containers in a 180° stacking configuration is provided comprising: (i) placing a second upper container in a 180° stacking configuration with respect to a similar first lower container, wherein the first and second containers include a base, and a front wall, rear wall, left side wall, and right side wall, the walls substantially orthogonal and joined to each other, and substantially perpendicular to and joined to the base, wherein the right side wall includes a right side wall channel located at an uppermost portion of the right side wall, front and rear stacking feet, wherein the front stacking feet includes a first curved surface on a rearward facing portion of the front stacking feet, and further including a first angled surface on a frontward facing portion of the front stacking feet, and the rear stacking feet includes a second curved surface on a frontward facing portion of the rear stacking feet, and wherein, the left side wall includes a left side wall channel located at an uppermost portion of the left side wall, front and rear stacking feet, wherein the front stacking feet includes a third curved surface on a rearward facing portion of the front stacking feet, and further including a second angled surface on a frontward facing portion of the front stacking feet, and the rear stacking feet includes a fourth curved surface on a frontward facing portion of the rear stacking feet, and wherein, the right side wall further includes front and rear 180° stacking receptacles, and the left side wall further includes front and rear 180° stacking receptacles, and wherein in the 180° stacking configuration the rear wall of the second upper container faces the same direction as the front wall of the first lower container; (ii) lifting the second upper container by its front wall such that the second and fourth curved surfaces of the rear stacking feet of the second upper container slidingly engage and rotate in a substantially smooth rotational manner with substantially similarly curved surfaces of the left and right side front stacking receptacles of the first lower container to the point wherein a front portion of a bottom portion of the rear stacking feet of the second upper container are extracted from the left and right side front stacking receptacles of the first lower container; and (iii) sliding the second upper container in the direction of the rear wall of the lower container such that the bottom portion of each of the left and right side wall rear stacking feet of the second upper container contacts and then slides upon the left side wall channel and right side wall channel, respectively, of the first lower container, thereby unstacking the second upper container from the first lower container.

According to the seventh aspect of the present invention, the method further comprises (ii) alternatively lifting the second upper container by its rear wall such that the first and third curved surfaces of the front stacking feet of the second upper container slidingly engage and rotate in a substantially smooth rotational manner with substantially similarly curved surfaces of the left and right side rear stacking receptacles of the first lower container to the point wherein a rear portion of a bottom portion of the front stacking feet of the second upper container are extracted from the left and right side rear stacking receptacles of the first lower container; and (iii) sliding the second upper container in the direction of the front wall of the lower container such that the bottom portion of each of the left and right side wall front stacking feet of the second upper container contacts and then slides upon the left side wall channel and the right side wall channel, respectively, of the first lower container, thereby unstacking the second upper container from the first lower container.

According to an eighth aspect of the present invention, a method is provided for counting containers, comprising: (i) placing one or more containers in a substantially similarly orientation; (ii) transmitting an optical signal from a counting machine at a side of a container; (iii) reflecting the transmitted optical signal from the container back towards the counting machine; (iv) receiving the reflected optical signal at the counting machine; (v) incrementing a counter in the counting machine by one upon receiving the reflected optical signal at the counting machine; (vi) dispersing the continuously transmitted optical signal in a plurality of directions from the counted container such that an additional count does not occur within the counting machine; and (vii) incrementing the container count by one when a subsequent container is illuminated by the optical signal from the counting machine only when the first container has ceased to be illuminated by the optical signal from the counting machine, and the subsequent container has reflected the transmitted optical signal such that the counting machine receives the reflected optical signal and thereby increments the counter within the counting machine.

According to the eighth aspect of the present invention, the method further comprises (viii) placing the one or more containers on a movable surface; and (ix) moving the one or more containers by the movable surface by the counting machine. Still further according to the eighth aspect of the present invention, the method alternatively further comprises (viii) placing one or more containers on a stationary object; and (ix) moving the counting machine by the stationary one or more containers.

According to the eighth aspect of the present invention, the optical signal is a laser signal, or an infra-red signal. According to the eighth aspect of the present invention, the step of dispersing the optical signal comprises: (a) dispersing the optical signal by a substantially glossy free surface on the one or more containers. Still further according to the eighth aspect of the present invention, the substantially glossy free area comprises one or more of a plurality of micro-bumps, diamond etchings, recesses, ribs, grooves, and various other types of markings, indentations and other alterations of the surfaces each of the respective front, rear, left side, and rear side walls.

BRIEF DESCRIPTION OF THE DRAWINGS

The novel features and advantages of the present invention will best be understood by reference to the detailed description of the preferred embodiments which follows, when read in conjunction with the accompanying drawings, in which.

DETAILED DESCRIPTION OF THE PREFERRED EMBODIMENTS

Figure 1:
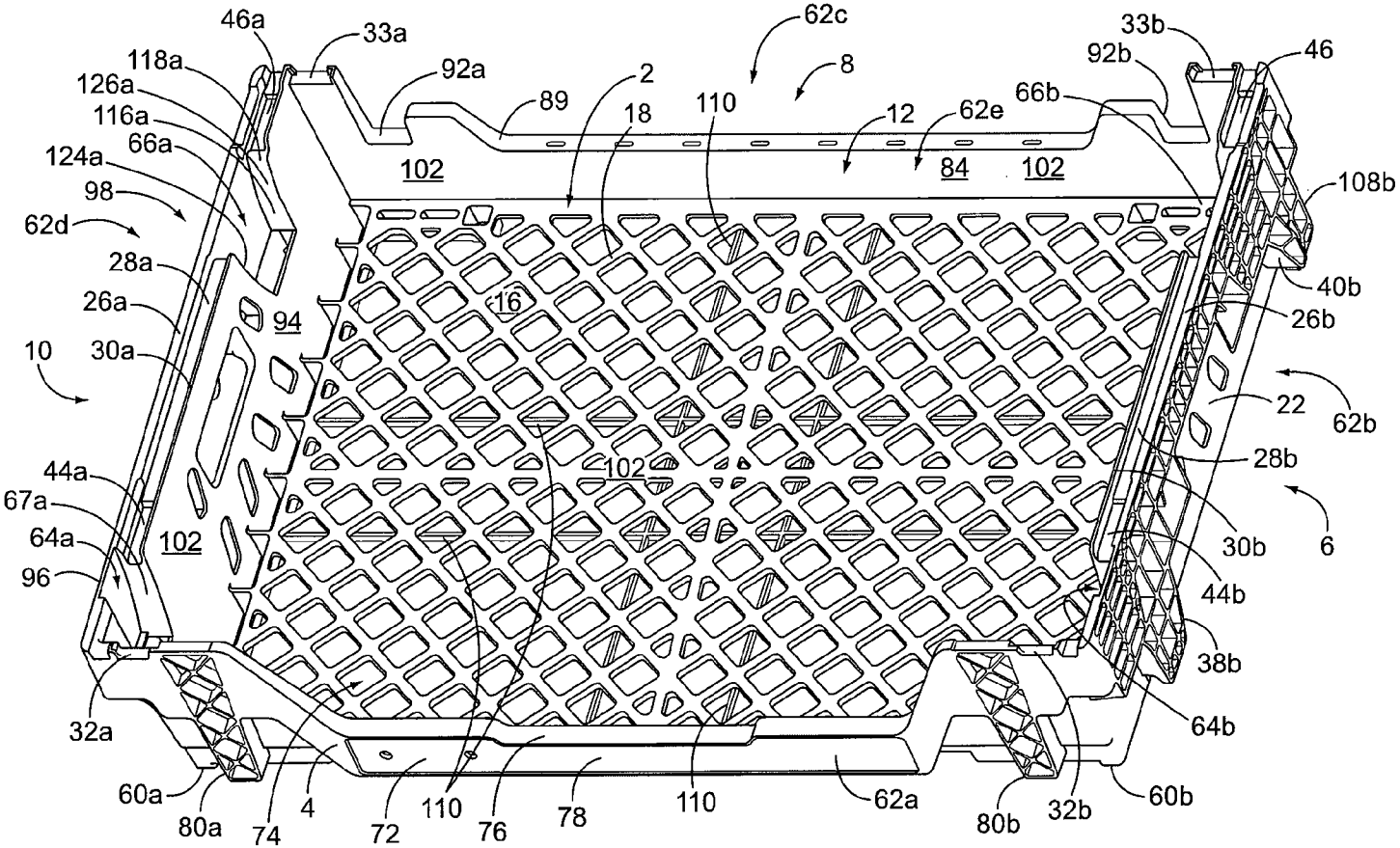
FIG. 1 illustrates a top perspective view of a container according to an embodiment of the present invention.
Figure 2:
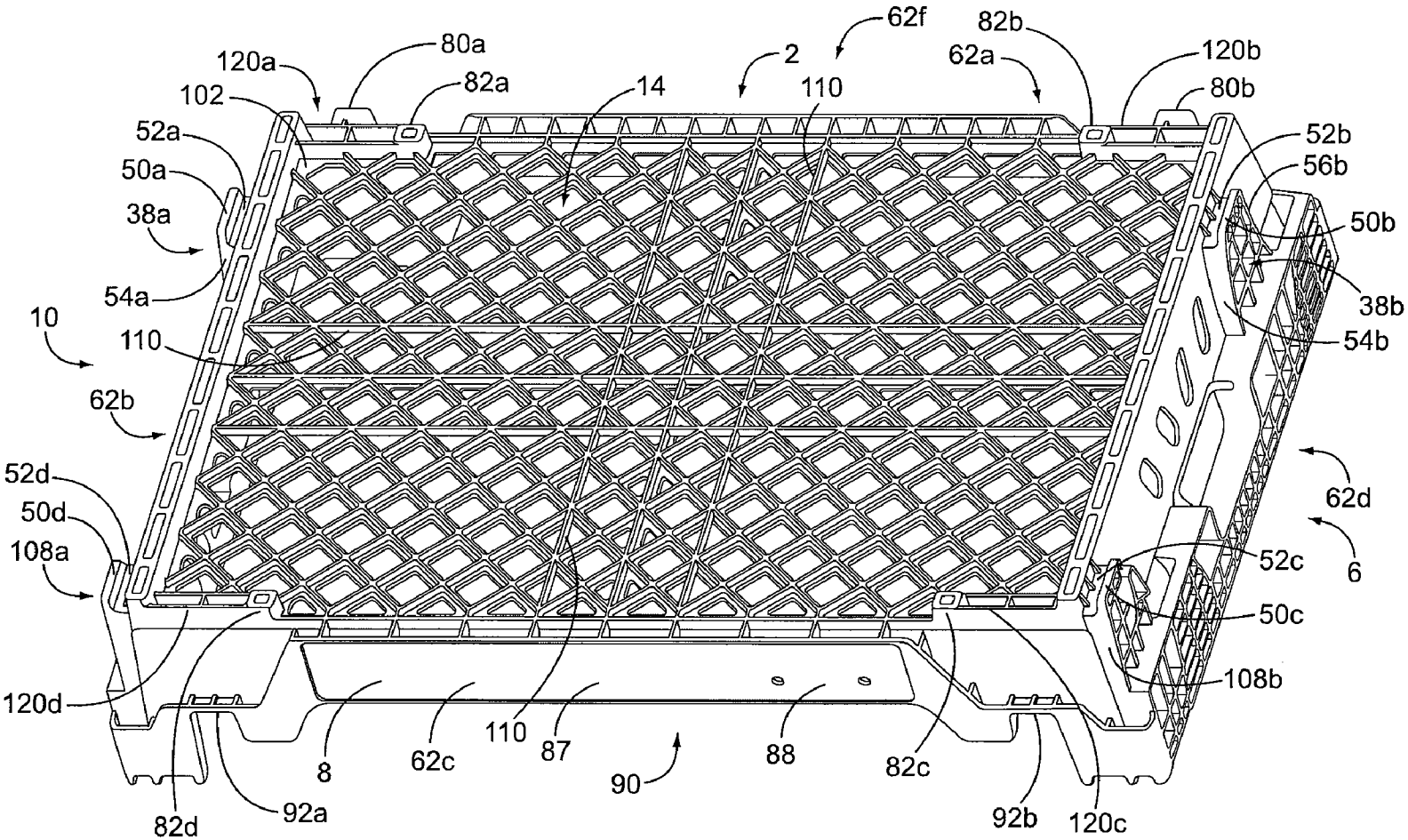
FIG. 2 illustrates a bottom perspective view of the container shown in FIG. 1.
Figure 3:
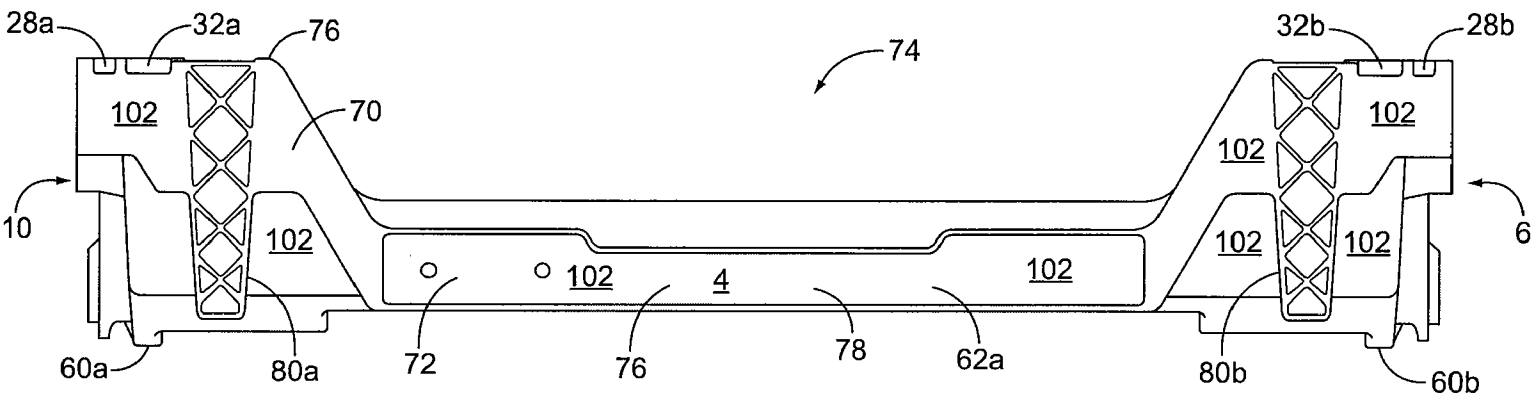
FIG. 3 illustrates a front view of the container shown in FIG. 1.
Figure 4:
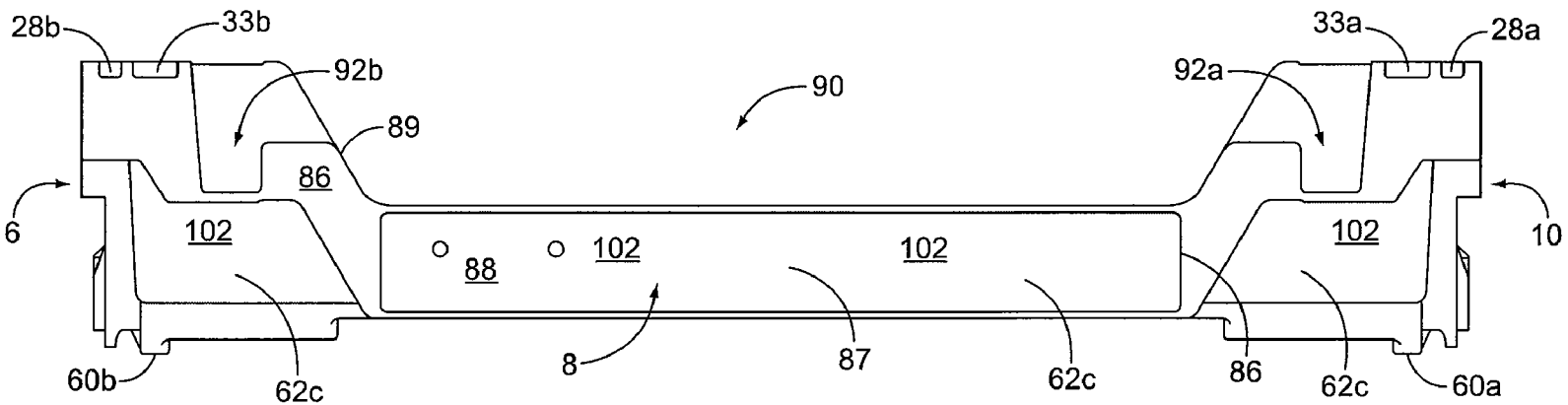
FIG. 4 illustrates a rear view of the container shown in FIG. 1.

The various features of the preferred embodiments will now be described with reference to the drawing figures, in which like parts are identified with the same reference characters. The following description of the presently contemplated best mode of practicing the invention is not to be taken in a limiting sense, but is provided merely for the purpose of describing the general principles of the invention.

I. SUMMARY OF THE EXEMPLARY EMBODIMENTS OF THE INVENTION

Container 100 comprises a base 2, front wall 4 and rear wall 8, left side wall 10 and right side wall 6, wherein the walls are all substantially orthogonal to each other and the base 2. Container 100 is preferably constructed from high density polyethylene (HDPE) plastic, though other materials can also be used. Container 100 is preferably used in the baked product industry to carry products such as loaves of bread, rolls, buns, and other similar products. As one of ordinary skill in the art can appreciate, however, other types of products, or goods, can also be carried in container 100.

Figure 9:
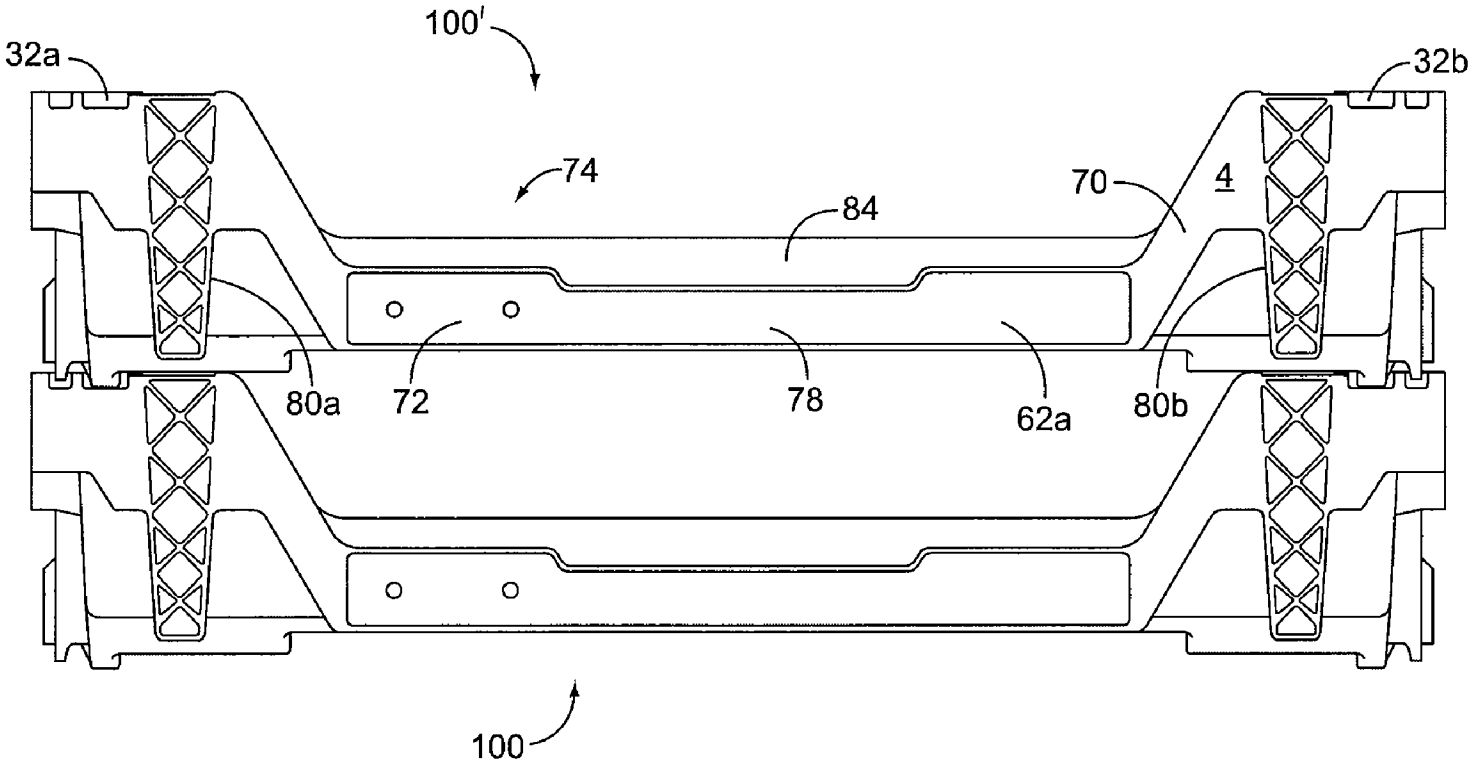
FIG. 9 illustrates a front view of two containers shown in FIG. 1 in a 0° stacking configuration according to an embodiment of the present invention.
Figure 14:
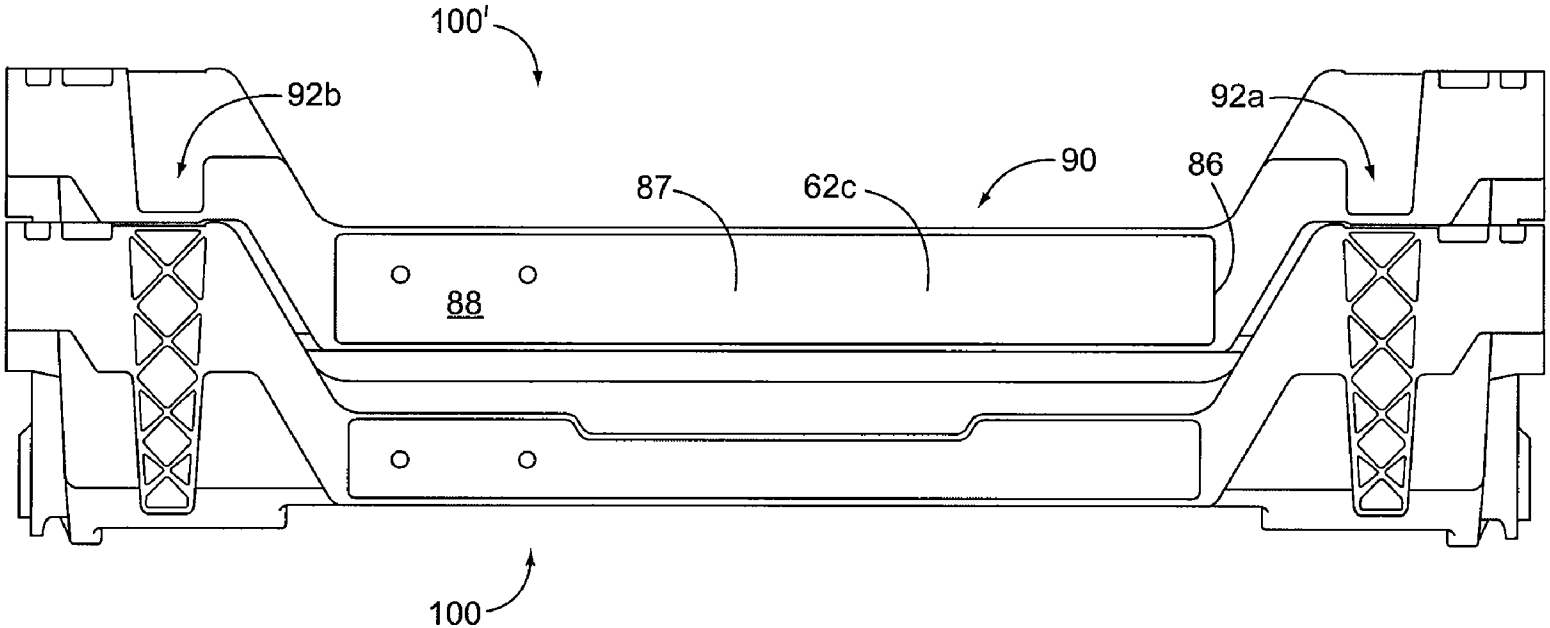
FIG. 14 illustrates a front view of two containers shown in FIG. 1 shown in a 180° stacking configuration according to an exemplary embodiment of the present invention.

Two or more like containers 100 can be stacked in either a 0° stacking configuration, or a 180° stacking configuration. In the 0° stacking configuration, the upper container (designated as container 100'), rests upon a lower container 100 and faces the same direction. In a 180° stacking configuration, rear wall 8' of the upper container 100' is in the same direction as front wall 4 of lower container 100. FIG. 9 illustrates a 0° stacking configuration, and FIG. 14 illustrates a 180° stacking configuration according to an embodiment of the present invention.

As briefly described above, container 100 comprises a base 2, a front wall 4, a left and right side wall 10, 6, and a rear wall 8. Each of the walls further comprises several features that assist in the stacking of like containers 100, and the retrieval of like containers 100 from the stacking configurations. For example, left side wall 10 comprises front stacking feet 38*a*, rear stacking feet 108*a*, and right side wall 6 comprises front stacking feet 38*b* and rear stacking feet 108*b* each of which further comprise several inventive features according to an exemplary embodiment of the present invention.

Rear stacking feet 108*a* and 108*b* of the left and right side walls 10, 6 each comprise rear stacking feet curved surfaces 58*a, b* respectively. Front stacking feet 38*a, b* of both the left and right side walls 10, 6 comprise front stacking feet curved surfaces 54*a, b* respectively, as well as front stacking feet angled surface 56*a, b* respectively. Rear stacking feet curved surfaces 58*a, b* of rear stacking feet 108*a, b* are reciprocally received by front stacking feet receptacles 66*b*, a located on an inner surface of the right and left side walls 6, 10 when an upper container 100' is placed on container 100 in a 180° stacking configuration (see FIG. 14). If the upper container 100' is lifted by its front wall 4' (which is located over rear wall 8 of the lower container 100), the rear stacking feet curved surfaces 58*a, b* slide over a substantially similarly curved surface 67*b*, a of front stacking receptacles 64*b*, a. The interaction between the curved surfaces 67*a, b* of the front stacking receptacle 64*a, b* and the rear stacking feet 108*a, b* makes retrieval of the upper container 100' from the lower container 100 substantially easier than if square or rectangular surfaces are used in the rear stacking feet 108*a, b*.

Similarly, front stacking feet 38*a, b* comprise curved surfaces 58*a, b* and angular surfaces 56*a, b*, and these are reciprocally received by rear stacking feet receptacles 66*a, b* located on an inner surface 94, 20 of the left and right side walls 10, 6 when an upper container 100' is placed on container 100 in a 180° stacking configuration. If the upper container 100' is lifted from its rear wall 8' (which is located over front wall 2 of lower container 100), curved surfaces 54*b*, a of the front stacking feet 38*a, b* slide over a substantially similarly curved surfaces 124*a, b* of rear stacking receptacles 66*a, b*. The interaction between the curved surfaces 124*a, b* of the rear stacking receptacles 66*a, b* and front stacking feet 38*a, b* (on both the left and right side walls 10, 6) makes retrieval of the upper container 100' from the lower container 100 substantially easier than if square or rectangular surfaces are used in the front stacking feet 38*a, b*.

According to other exemplary embodiments of the present invention, substantially glossy free areas 62*a-d* are provided on exterior surfaces of all four walls, respectively. The substantially glossy free area 62*a, c* on the outer surface 70, 86 of the front and rear walls 4, 8 provides a substantially non-glossy surface so that if sticker is placed on the substantially non-glossy free areas 62*a, c* of front and rear walls 4, 8, they can be easily removed during a cleaning process. The substantially glossy free areas 62*d, b* of the left and right side walls 10, 6 are used to prevent or alleviate container counting devices, which, according to an exemplary embodiment of the present invention, utilize optical transceivers, from misreading a single container as multiple containers. According to an exemplary embodiment of the present invention, the substantially glossy free areas 62*d, b* prevents reflection of a light beam from being received by an optical receiver, and may comprise a plurality of micro-bumps, recesses, ribs, grooves, and various other types of markings, indentations and other alterations of the surface, which shall be described in greater detail below. According to a preferred embodiment of the present invention, the light beam is generated by an infra-red transmitter or a laser. Further, according to another exemplary embodiment of the present invention, the rear stacking feet 108*a, b* on both the left and right side walls 10, 6 include projections 40*a, b*, respectively, on a lower portion of the rear stacking feet 108*a, b*, wherein during stacking in a 0° stacking configuration, the projections 40*a, b* ride over left and right outer rails 26*a, b*, respectively, on the left and right side walls 10, 6, substantially preventing the upper container 100' from lateral movement and provides loading strength during the sliding motion before being completely positioning in the 0° stacking configuration.

The exemplary embodiments of the preferred embodiments of the present invention shall now be described in greater detail.

II. COMPONENTS OF CONTAINER 100

A. Front Wall 4

As shown in FIGS. 1-3, and 7, front wall 4 includes an inner surface 68 and outer surface 70. Outer surface 70 includes a radio frequency (RF) identification (ID) tag (RFID tag) area 72. Front wall 4 further includes a top surface 76, and a nameplate area 78. On both sides of front wall 6, located a short distance from either side walls 10, 6 are left front stacking foot 80*a* and right front stacking foot 80*b*. Left and right front stacking feet 80*a, b* provide substantial support for the contents of container 100 when stacked in both a 0° stacking configuration and a 180° stacking configuration as shown in FIGS. 9-13, and 14-19, respectively, and as discussed in greater detail below. Front wall 4 also includes front wall left inner channel 32*a* and front wall right inner channel 32*b*.

Front wall 4 further includes a merchandise window (window) 74. Window 74 allows consumers to retract merchandise, specifically baked products, from the interior portion of container 100 when stacked upon other similar containers 100'. Users reach their hands through window 74, grasp the desired product, and retrieve it through window 74. Notice that window 74 is not simply an "absent" or "missing" front wall 6. An absent front wall 6 would not prevent baked product from spilling out during transit. Baked product is loaded onto the containers after baking and then transported in trucks and on carts fully or partially loaded. Enough of a wall is retained even with window 74 so that such spillage is substantially prevented.

B. Rear Wall 8

Reference is made to FIGS. 1, 2, 4 and 7. As shown in FIGS. 1, 2, 4 and 7, rear wall 8 includes an inner surface 84 and outer surface 86. Outer surface 86 includes RFID tag area 88. Rear wall 8 further includes a top surface 89, and a nameplate area 87. On both sides of rear wall 8, located a short distance from side walls 10, 6, are left 180° stacking foot receptacle 92*a*, and right 180° stacking foot receptacle 92*b*. Left and right 180° stacking feet receptacles 92*a, b* provide substantial support for the contents of an upper container 100' when stacked in a 180° stacking configuration as shown in FIGS. 14-18, as discussed in greater detail below (left front stacking foot 80*a* fits into right 180° stacking foot receptacle 92*b*, and right front stacking foot 80*b* fits into left 180° stacking foot receptacle 92*a*). Rear wall 8 also includes rear wall left inner channel 33*a* and rear wall right inner channel 33*b*. Front wall left inner channel 32*a* and rear wall left inner channel 33*a* are substantially aligned with each other, as are front wall right inner channel 32*b* and rear wall right inner channel 33*b*. Each of the front wall left inner channel 32*a*, rear wall left inner channel 33*a*, front wall right inner channel 32*b*, and rear wall right inner channel 33*b* provide a path, or channel, for left and right lower rails 60*a, b*, which are part of base 2, when an upper container 100' is in both the 0° and 180° stacking configuration with respect to lower container 100.

C. Right Side Wall 6

Reference is made to FIGS. 1, 2, and 6-10 for a description of right side wall 6. As shown in FIGS. 1, 2, and 6-10, right side wall 6 includes an inner surface 20, an outer surface 22, a top surface 24, and a right side top outer rail 26. Right side top outer rail 26*a* includes right top rail indent 42*b*. A top portion of outer surface 22 includes a plurality ridges to add strength and integrity to right side wall 6. Right side wall 6 further includes right side wall outer channel 28*b*. Right side wall outer channel 28*b* runs the width of right side wall 6, from front wall 4 to rear wall 8. Included in right side outer wall channel 28*b* are front indent right side wall outer channel 44*b*, and rear indent right side wall outer channel 46*b*. Right side wall 6 further includes right handle 34, a plurality of ventilation holes 36, and substantially glossy free area 62*b*.

Figure 8:
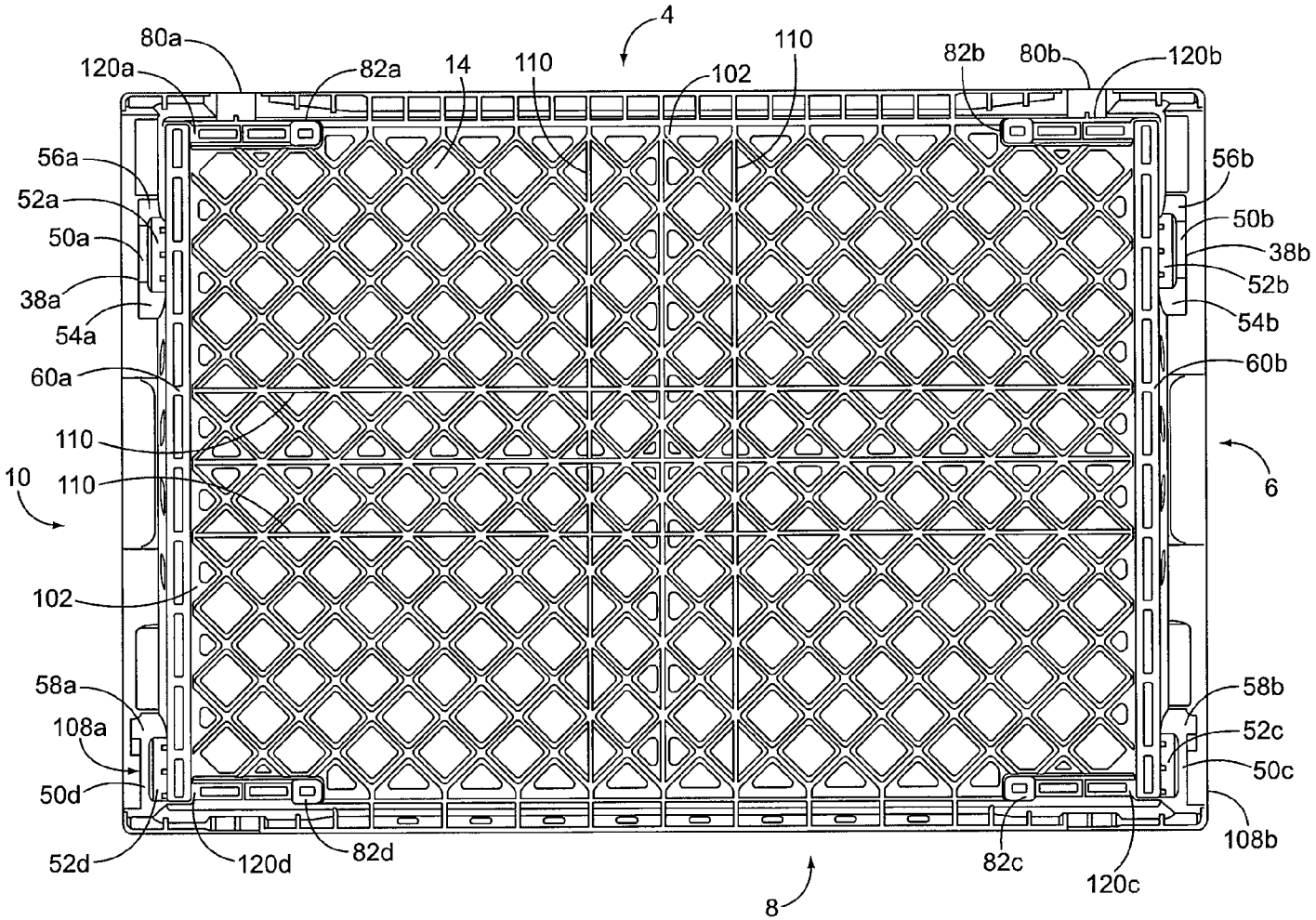
FIG. 8 illustrates a bottom view of the container shown in FIG. 1.

As discussed above, right side wall 6 includes right front stacking feet 38*b*, and right rear stacking feet 108*b*. Right front stacking feet 38*b* includes right front stacking foot angled surface 56*b*, and right front stacking foot curved surface 54*b*, seen best in FIG. 6. Right rear stacking feet 108*b* include right rear stacking foot curved surface 58*b*, and right rear stacking foot projection 40*b*. As seen in FIG. 8, on the bottom of right front stacking foot 38*b* are right front stacking foot wall 50*b*, and right front stacking foot channel 52*b*. An identical configuration is formed in right rear stacking feet 108*b*, comprising right rear stacking foot wall 50*c*, and right rear stacking foot channel 52*c*.

As discussed above, right front stacking foot curved surface 54*b* comprises a curved surface. The curved surface, as those of ordinary skill in the art can appreciate, can be any type of curved surface. That is, the curved surface can be elliptical in shape, parabolic, circular, semi-circular, hyperbolic, oval, or any other type of curved shape. Further, it should be appreciated that the curved surface of right front stacking foot curved surface 54*b* (as well as right rear stacking foot curved surface 58*b*) need not be "truly" curved at all, but can be formed from a plurality of flat, angled surfaces, wherein the angular differences between each surfaces approximates a curved surface. For example, if the height of right front stacking foot curved surface 54*b* were 3", and forms about a 70° angle from base 2 of container 100, then an approximated curved surface comprising only two flat angled surfaces would consist of a first flat angled surface at the 70° angle, but only 2" high. Then a second flat angled surface would be joined at the top of the first angled surface, but at an angle of perhaps 10° with respect to the first angled surface. By increasing the number of angled surfaces, and decreasing the angle differences between the subsequent flat angled surfaces, a "true" curve can be approximated. As one of ordinary skill in the art can appreciate, creating flat angled surfaces can be done to make it easier to machine the mold that produces container 100 using high pressure injection molding techniques. The approximation of curved surfaces using flat angled surfaces on right front stacking foot curved surface 54*b* and right rear stacking foot curved surface 58*b*, can also be used on left front stacking foot curved surface 38*a* and left rear stacking foot curved surface 54*a*, as well as left, right front stacking receptacle curved surfaces 67*a, b*, and left, right rear 180° stacking receptacle curved surfaces 126*a, b*, which are discussed in detail below.

Figure 7:
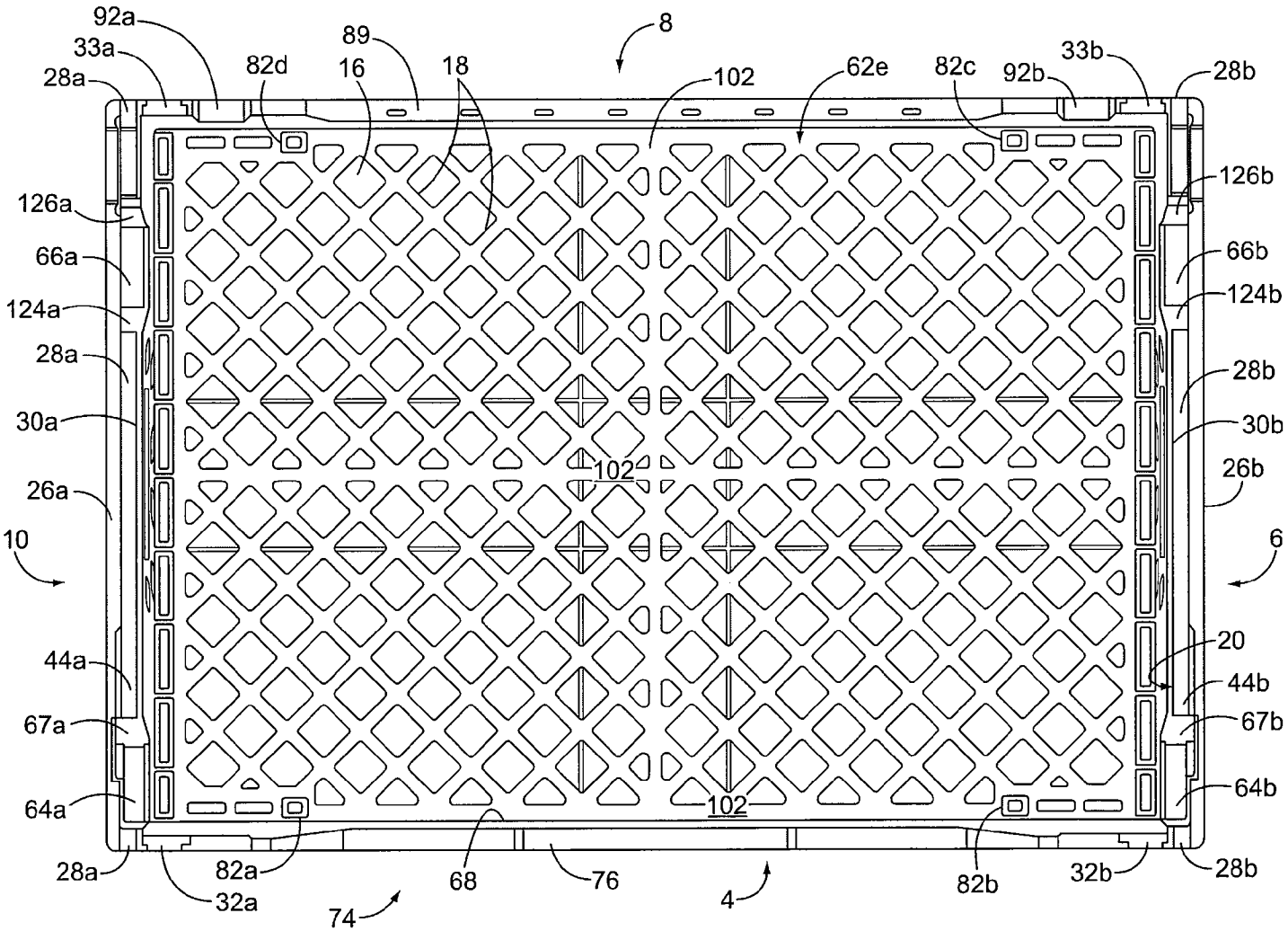
FIG. 7 illustrates a top view of the container shown in FIG. 1.

Referring now to FIGS. 1 and 7, right side wall 6 further includes right front 180° stacking receptacle 64*b*, and right rear 180° stacking receptacle 66*b*. Right front stacking receptacle 64*b* includes a front surface that is substantially planar with front wall inner surface 68. Right rear 180° stacking receptacle 66*b* includes right rear stacking receptacle curved surface 124*b*, and right rear stacking receptacle angled surface 126*b*. Right side wall 6 further includes right side wall top inner rail 30*b*. Right side wall top inner rail 30*b* forms right side wall outer channel 28*b* along with right side wall top outer rail 26*b*, and runs the width of right side wall 6 from front wall 4 to rear wall 8. Located at the rear of right side wall top inner rail 30*b* is right side wall inner rail indent 48*b*.

D. Left Side Wall 10

Reference is made to FIGS. 1, 2, 5 and 7-10 for a description of left side wall 10. As shown in FIGS. 1, 2, 5, and 7-10, left side wall 10 includes an inner surface 94, an outer surface 96, a top surface 98, and left side top outer rail 26*a*. Left side top outer rail 26*a* includes left top rail indent 42*a*. A top portion of outer surface 96 includes a plurality ridges to add strength and integrity to left side wall 10. Left side wall 10 further includes left side wall outer channel 28*a*. Left side wall outer channel 28*a* runs the width of left side wall 10, from front wall 4 to rear wall 8. Included in left side outer wall channel 28*a* are front indent left side wall outer channel 44*a*, and rear indent left side wall outer channel 46*a*. Left side wall 10 further includes left handle 104, a plurality of ventilation holes 106, and substantially glossy free area 62*d*.

As discussed above, left side wall 10 includes left front stacking feet 38*a*, and left rear stacking feet 108*a*. Left front stacking feet 38*a* includes left front stacking foot angled surface 56*a*, and left front stacking foot curved surface 54*a*, seen best in FIG. 5. Left rear stacking feet 108*a* include left rear stacking foot curved surface 58*a*, and left rear stacking foot projection 40*a*. As seen in FIG. 8, on the bottom of left front stacking foot 38*a* are right front stacking foot wall 50*a*, and left front stacking foot channel 52*a*. An identical configuration is formed in left rear stacking feet 108*a*, comprising left rear stacking foot wall 50*d*, and left rear stacking foot channel 52*d*.

Referring now to FIGS. 1 and 7, left side wall 10 further includes left front 180° stacking receptacle 64*a*, and left rear 180° stacking receptacle 66*a*. Left front stacking receptacle 64*a* includes a front surface that is substantially planar with front wall inner surface 68. Left rear 180° stacking receptacle 66*a* includes left rear stacking receptacle curved surface 124*a*, and left rear stacking receptacle angled surface 126*a*. Left side wall 10 further includes left side wall top inner rail 30*a*. Left side wall top inner rail 30*a* forms left side wall outer channel 28*a* along with left side wall top outer rail 26*a*, and runs the width of left side wall 10 from front wall 4 to rear wall 8. Located at the rear of left side wall top inner rail 30*a* is left side wall inner rail indent 48*a*.

Figure 5:
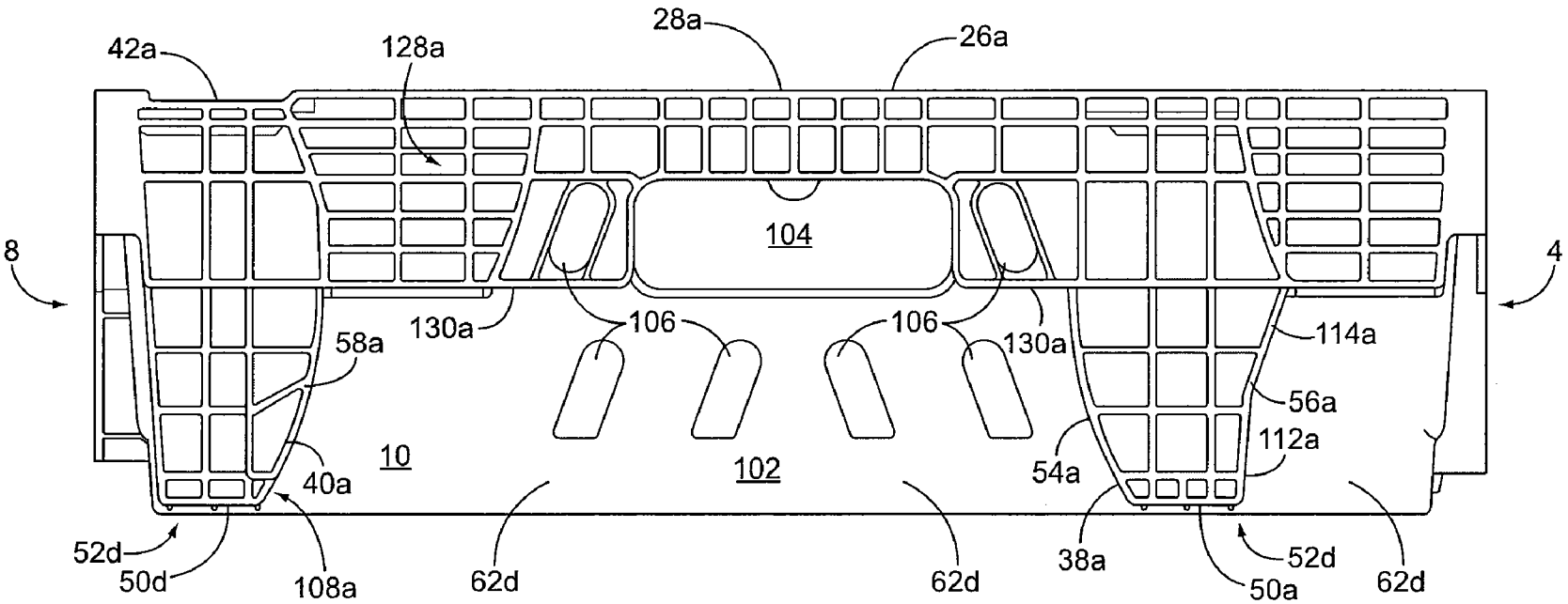
FIG. 5 illustrates a left side view of the container shown in FIG. 1.
Figure 6:
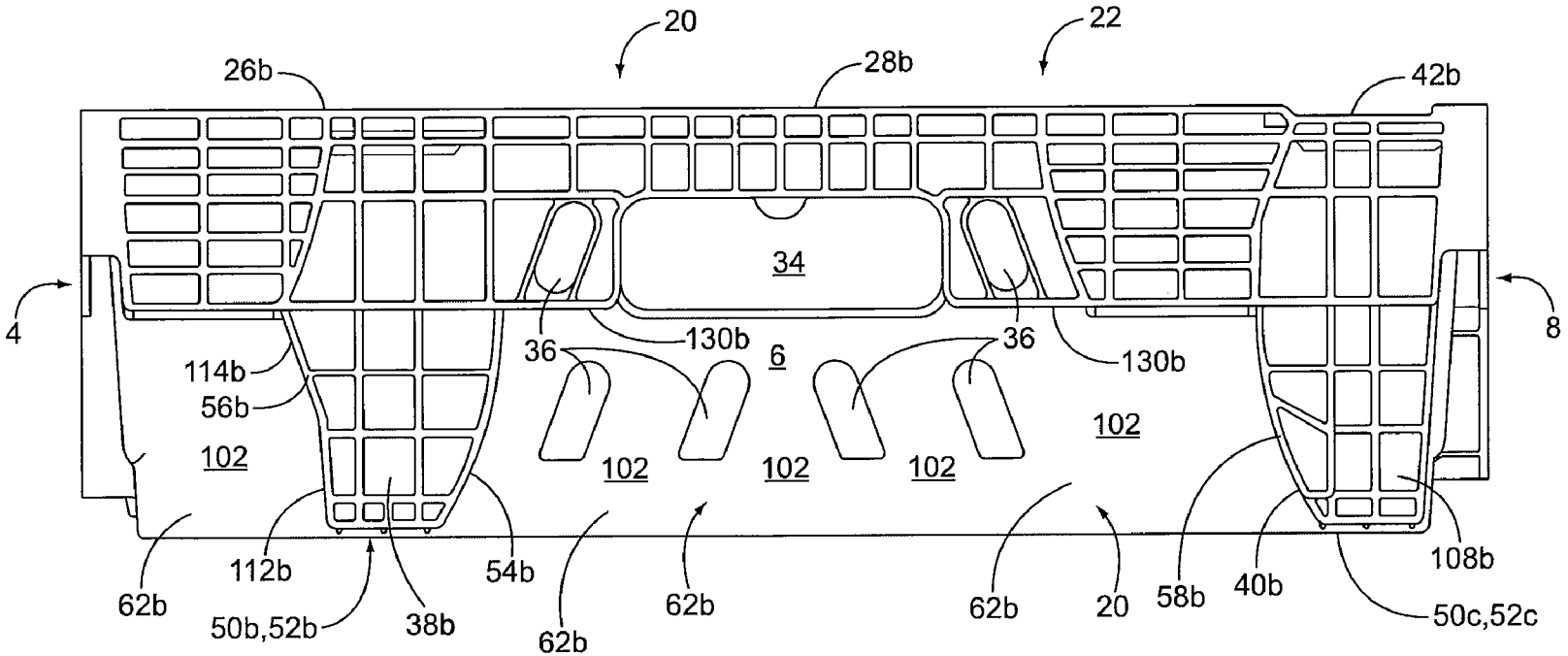
FIG. 6 illustrates a right side view of the container shown in FIG. 1.

Each of the front stacking feet angled surfaces 56*a, b* includes a lower angled surface 112*a, b* and an upper angled surface 114*a, b*, as shown in FIG. 5. Lower angled surfaces 112*a, b* are formed, according to an exemplary embodiment of the present invention, at angle between about 3° and about 5° from the horizontal. According to a preferred embodiment of the present invention, lower angled surfaces 112*a, b* are formed at angle of about 4° from the horizontal. Upper angled surfaces 114*a, b* are formed, according to an exemplary embodiment of the present invention, at angle between about 9° and about 11° from the horizontal. According to a preferred embodiment of the present invention, upper angled surfaces 114*a, b* are formed at an angle of about 10° from the horizontal. The angled surfaces of both the left, right stacking feet 56*a, b* substantially prevent or alleviate binding when removing an upper container 100' from a lower container 100 in the 180° stacking configuration.

E. Base 2

Reference is made to FIGS. 1, 2, 7, and 8 for a description of base 2. As shown in FIGS. 1, 2, 7, and 8, base 2 comprises a plurality of interlocking base cross members 18, thereby creating a plurality of holes 16. Base 2 includes an upper surface 12, and a lower surface 14. Further, base 2 includes a plurality of base receptacles 82*a-d*, and base walls 120*a-d*, that join base receptacles 82*a-d* to base 2 and left and right side walls 10, 6.

III. STACKING

A. 0° Stacking Configuration

1. Stacking.

FIGS. 9-13 illustrate several different views of an upper container 100' and a lower container 100 stacked in a 0° stacking configuration. In the 0° stacking configuration, front wall 4 of upper container 100' faces the same direction as front wall 4' of lower container 100. The 0° stacking configuration provides the maximum distance between base 2 of lower container 100 and base 2' of upper container 100'. The 0° stacking configuration will be used, generally, when at least lower container contains some baked product. In many instances, however, as those of ordinary skill in the art can appreciate, both upper container 100' and lower container 100 will both be filled with baked product. The features provided for the 0° stacking configuration are especially important when containers 100', 100 are filled with baked product. These features provide superior strength to substantially prevent or avoid sagging, and several different features are included to make stacking and un-stacking substantially easier.

FIG. 9 illustrates a front view of containers 100', 100 when in a 0° stacking configuration. As FIG. 9 illustrates, front wall 4' of upper container 100' and front wall 4 of lower container 100 face in the same direction. Stacking feet 80*a'* rests upon stacking feet 80*a*, and stacking feet 80*b'* of upper container 100', rests upon stacking feet 80*b* of lower container 100. Note that stacking feet 80*a, b* are substantially wide across and include a plurality of stiffening/strengthening walls that criss-cross from top to bottom of the stacking feet 80*a, b*. Stacking feet 80*a, b* provide significant weight carrying capacity for upper container 100'. Stacking feet 80*a, b* are located inwardly from the outer front corners of container 100 so that when fully loaded with baked product, containers 100', 100 do not sag because of merchandise window 74. Because of merchandise window 74, front wall 4 of container 100 contains substantially less plastic material than do either left or right side walls 10, 6, or rear wall 8.

Figure 10:
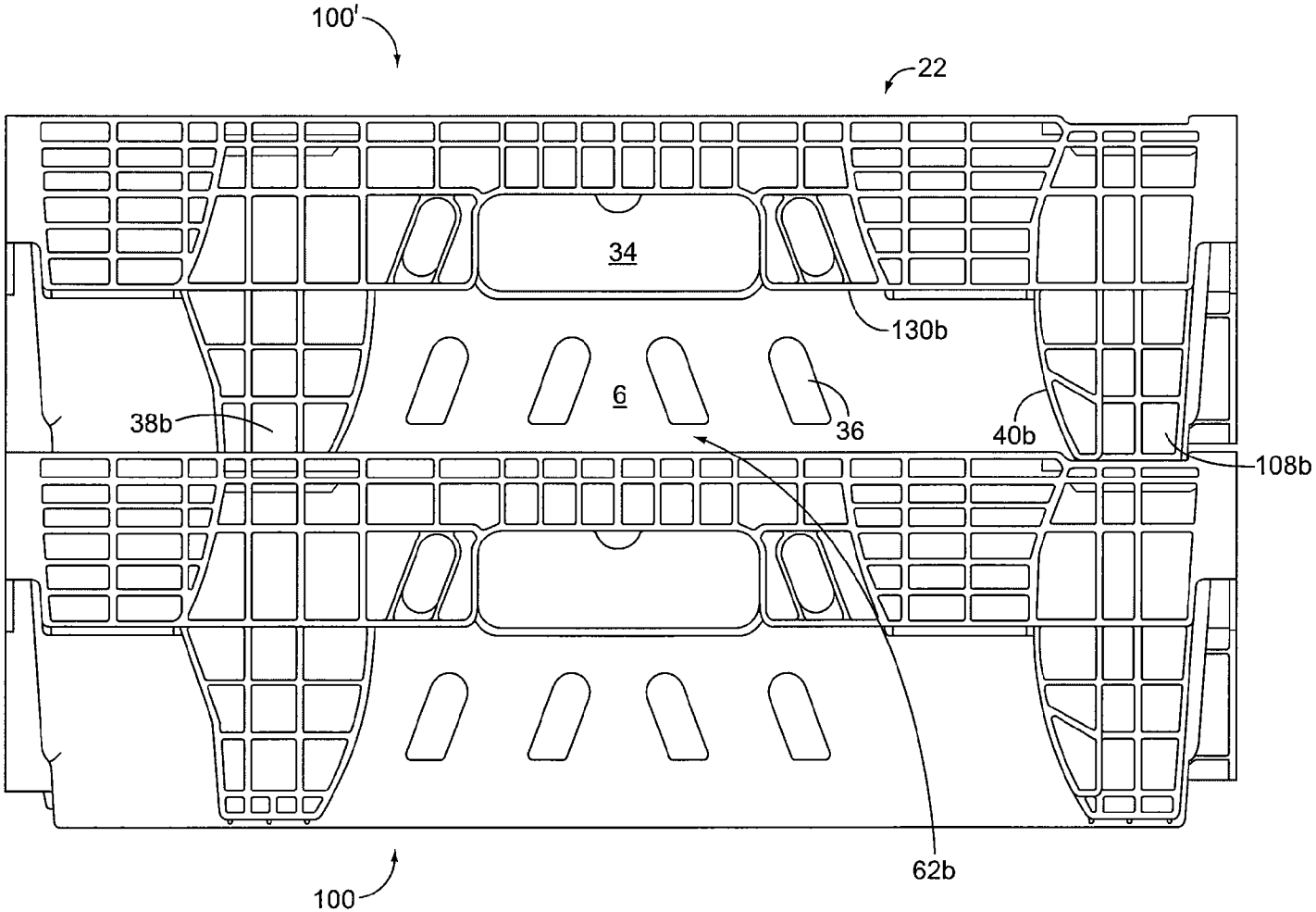
FIG. 10 illustrates a right side view of the two containers shown in FIG. 9.
Figure 11:
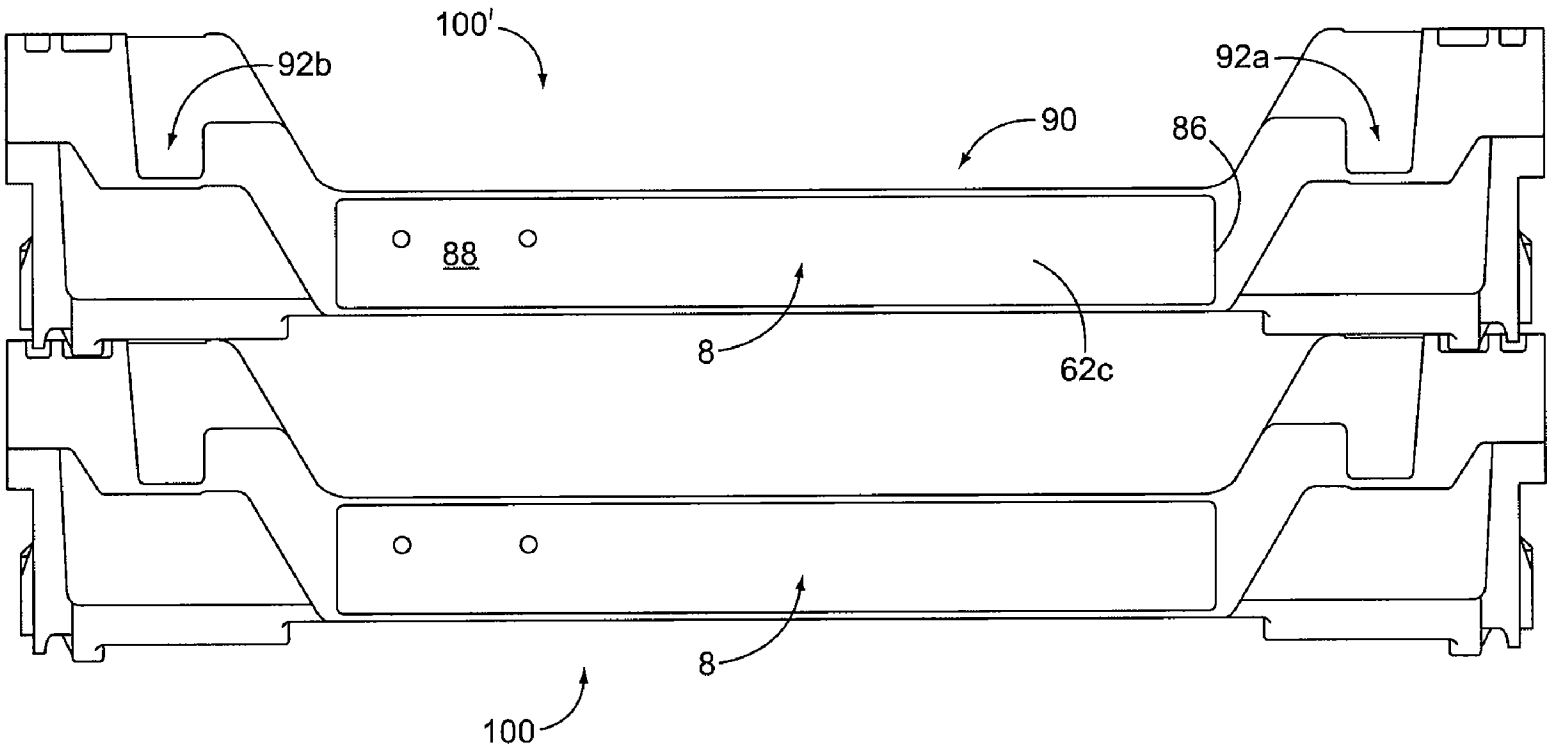
FIG. 11 illustrates a rear view of the two containers shown in FIG. 9.
Figure 12A:
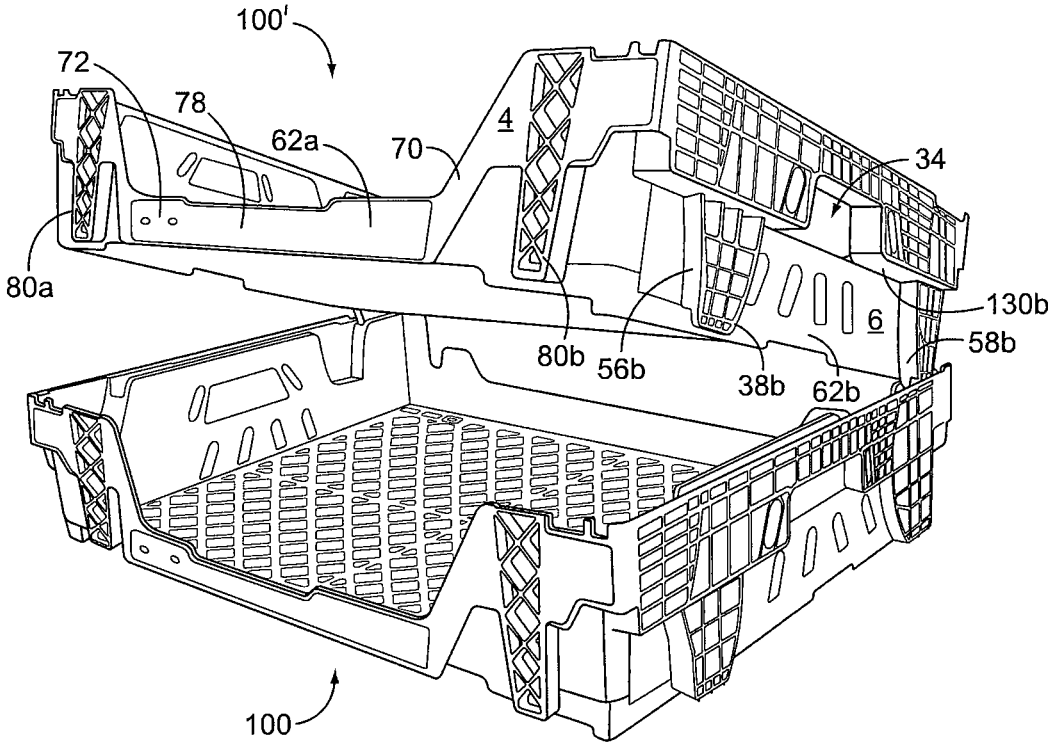
FIGS. 12A and 12B illustrate a front isometric view of the two containers shown in FIG. 9.
Figure 12B:
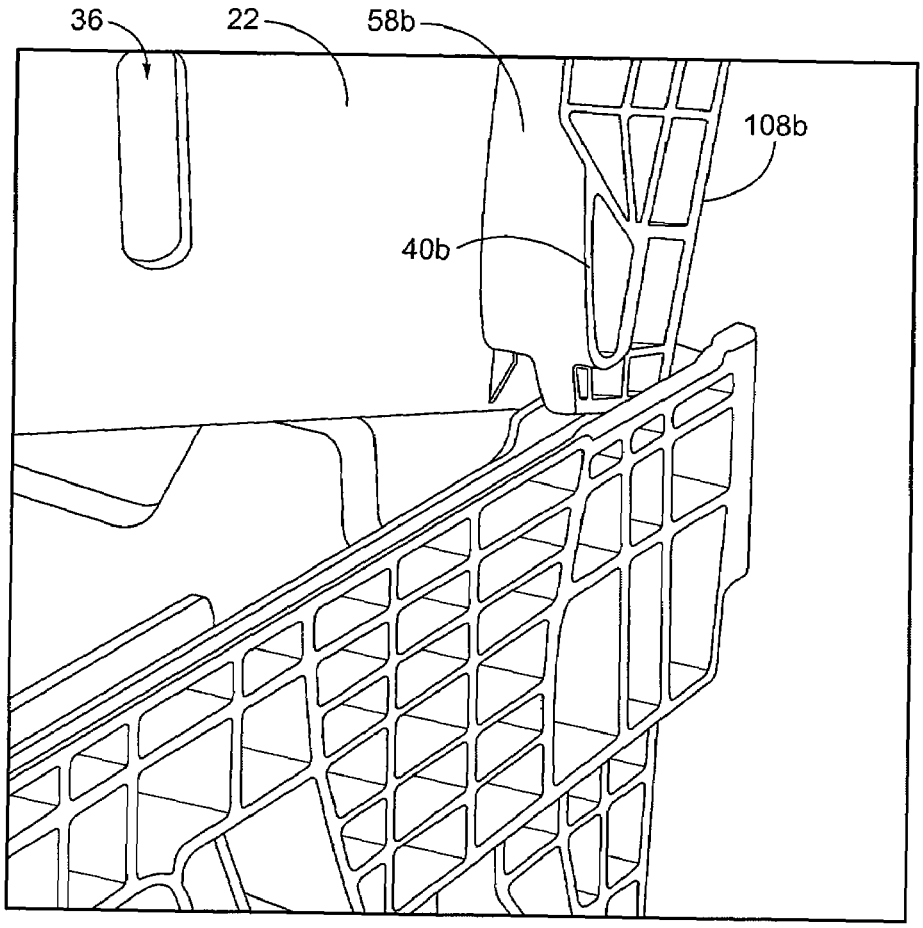
Figure 13A:
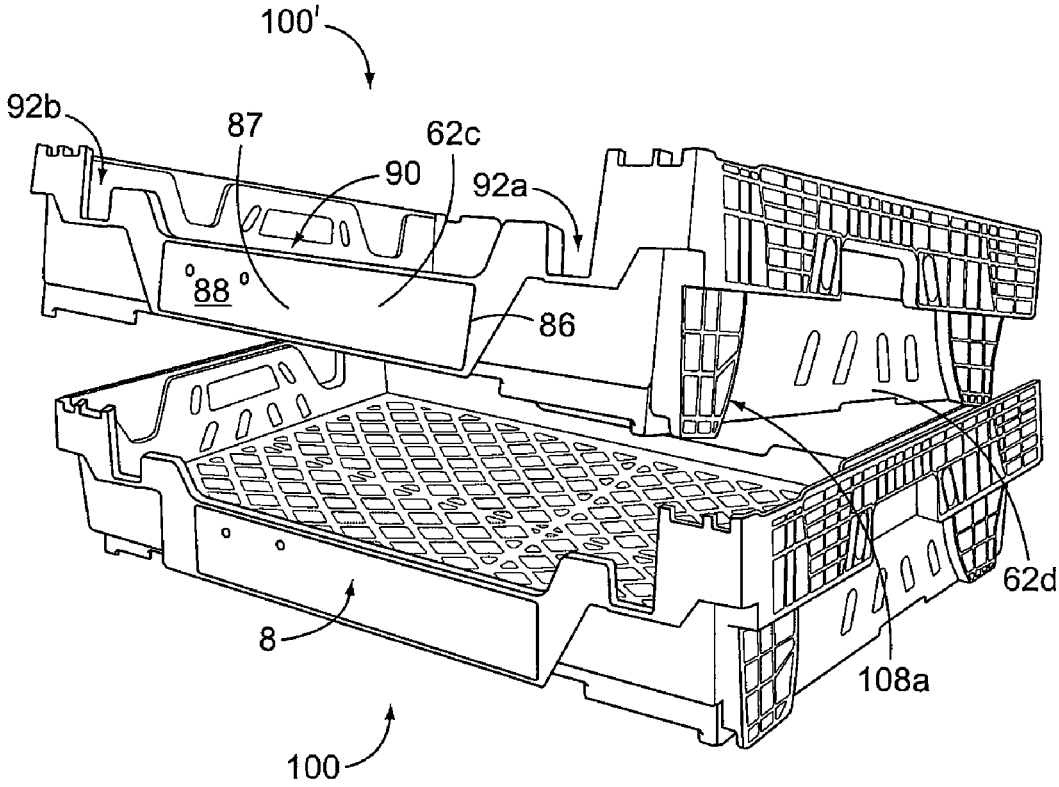
FIGS. 13A and 13B illustrate rear isometric views of the two containers shown in FIG. 9.
Figure 13B:
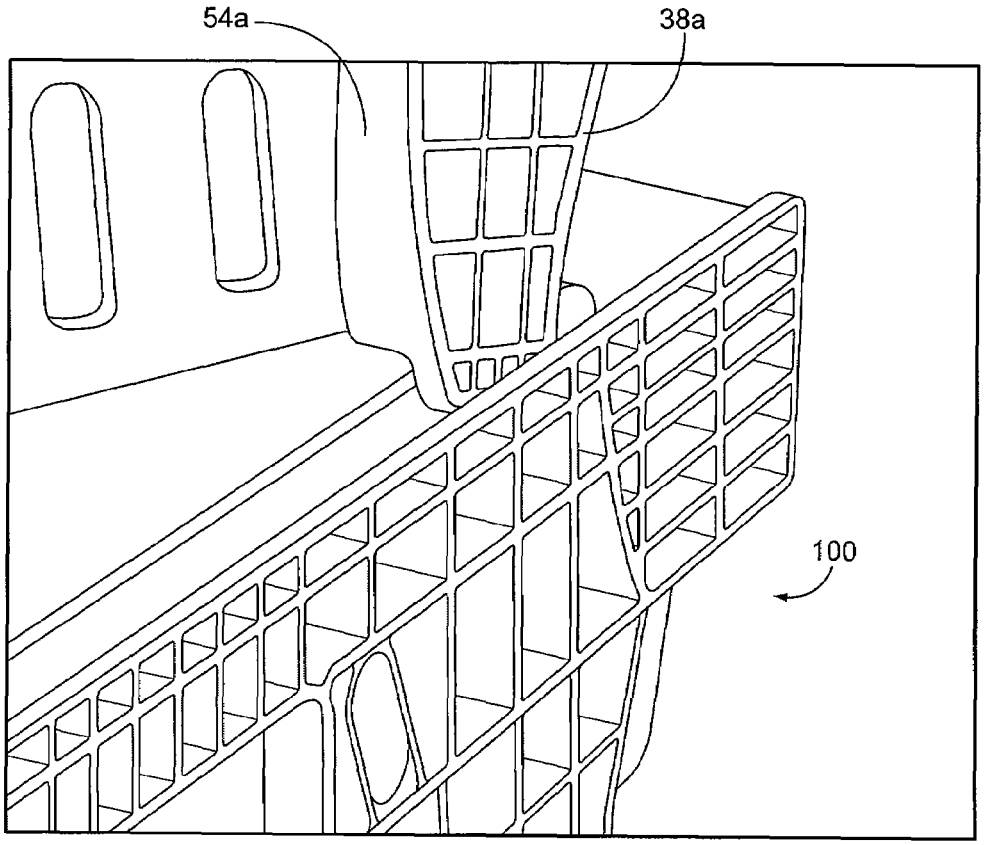

FIG. 10 illustrates a right view of containers 100', 100 when in a 0° stacking configuration, and FIG. 11 illustrates a rear view of containers 100', 100 when in the 0° stacking configuration. FIG. 10 illustrates another feature of container 100 that provides additional strength when the containers 100', 100 are loaded with baked products. As discussed above, container 100 includes right front stacking feet 38*b*, and right rear stacking feet 108*b*. Right front stacking feet 38*b* comprises right stacking feet wall 50*b* and right stacking feet channel 52*b*, and right rear stacking feet 108*b* comprises right stacking feet wall 50*c*, and right stacking feet channel 52*c*. Right stacking feet wall 50*b'* and right stacking feet channel 52*b'*, as well as right stacking feet wall 50*c'* and right stacking feet channel 52*c'* of upper container 100', interface and interlock with front indent right side wall outer channel 44*b* and rear indent right side wall outer channel 46*b* of lower container 100, respectively, interlocking with front indent right side wall outer channel 44*b* and rear indent right side wall outer channel 46*b* to provide side-to-side stability and strength in stacking. Furthermore, right stacking foot projection 40*b'* on the right side of upper container 100' sits directly upon right top rail indent 42*b* of lower container 100, and left stacking foot projection 40*a'* on the left side of upper container 100' sits directly upon left top rail indent 42*a* of lower container 100. The interface between left, right stacking foot projections 40*a', b'* of upper container 100' and left, right top rail indent 42*a, b* of lower container 100 provides at least two benefits: side-to-side motion between upper container 100' and lower container 100 is substantially prevented or reduced, and the weight of the baked products in upper container 100' is transferred through sidewalls 10, 6 of lower container 100, thereby substantially preventing or reducing sagging of base 2 of upper container 100'.

To stack upper container 100' upon lower container 100', a user can simply place a loaded or unloaded upper container 100' upon lower container 100 in the 0° stacked configuration. Alternatively, the user could place the rear wall 8' portion of upper container 100' on lower container 100 so that both left and right rear stacking feet 108*a', b'* and their respective stacking feet channels 52*c', d'* fit over left and right side top inner rails 30*a, b* respectively of lower container 100, and stacking feet walls 50*c', d'* sit within left and right side wall outer channel 28*a, b* of lower container 100. The interface between stacking feet walls 50*c', d'* and stacking feet channels 52*c', d'* of upper container 100', and left and right side top inner rails 30*a, b* and left and right sidewall outer channels 28*a, b* of lower container 100 provides a means for upper container 100' to slide substantially freely backwards over lower container 100 into the 0° stacking configuration. In addition, left and right lower rail 60*a', b'* of upper container 100' will rest, and then slide within, left and right front wall inner channels 32*a, b* of lower container 100. At some point, while upper container 100 is being slid backwards into the 0° stacking configuration, 50*a', b'* of upper container 100' slides over 30*a, b* of lower container 100, and 52*a', b'* of upper container 100' sit within 28*a, b* of lower container 100.

Conversely, the user could place a front wall 4' portion of upper container 100' on lower container 100 so that both left and right front stacking feet 38*a', b'* and their respective stacking feet channels 52*a', b'* fit over left and right side top inner rails 30*a, b* respectively of lower container 100 and stacking feet walls 50*a', b'* sit within left and right side wall outer channel 28*a, b* of lower container 100. In this configuration, rear wall 8' of upper container 100' is hanging over wall 8 rear of lower container 100. The interface between stacking feet walls 50*a', b'* and stacking feet channels 52*a', b'* of upper container 100' and left and right side top inner rails 30*a, b* and left and right side wall channels 28*a, b* of lower container 100 provides a means for upper container 100' to slide substantially freely frontwards over lower container 100 into the 0° stacking configuration. In addition, left and right lower rails 60*a', b'* of upper container 100' will rest, and then slide within, left and right rear wall inner channels 33*a, b* of lower container 100. At some point, while upper container 100 is being slid frontwards into the 0° stacking configuration, 50*c', d'* of upper container 100' slides over 30*a, b* of lower container 100, and 52*c', d'* of upper container 100' sit within 28*a, b* of lower container 100.

The 0° stacking configuration comprises that position wherein stacking feet walls 50*a', b'* of upper container 100' fits into front indents 44*a, b* on the left and right sidewall outer channel, 28*a, b* and wherein stacking feet walls 50*c', d'* of upper container 100' fits into rear indents 46*b*, a on the right and left sidewall outer channel 28*b*, a of lower container 100. In the 0° stacking configuration, upper container 100' is substantially immobile with respect to lower container 100.

2. Un-Stacking

To un-stack upper container 100' from lower container 100, the user can simply lift upper container 100' approximately straight up and off lower container 100. Alternatively, the user can lift up front wall 4' of upper container 100' slightly (see FIGS. 12A and 12B), and pull forwards upper container 100' frontwards over front wall 4 of lower container 100, or lift up rear wall 8' of upper container 100' slightly (see FIGS. 13A and 13B), and slide rearwards upper container 100' over rear wall 8 of lower container 100. If the user lifts front wall 4' up and over front wall 4 of lower container 100, then left and right lower rails 60*a'*, *b'* of upper container 100' are now in left and right front wall inner channels 32*a, b* of lower container 100. Stacking feet walls 50*a'*-*d'* are unseated from their respective positions in both front indents 44*a, b* and rear indents 46*a, b* on the left and right sidewall outer channels 28*a, b* of lower container 100. Upper container 100' can now slide substantially freely forwards such that stacking feet channels 52*a'*-*d'* slide over left and right side wall rails 30*a, b* of lower container 100. Alternatively, if the user lifts rear wall 8' up and over rear wall 8 of lower container 100, then left and right lower rails 60*a, b* are now in left and right rear wall inner channels 33*a, b* of lower container 100. Stacking feet walls 50*a'*-*d'* are unseated from their respective positions in both front indents 44*a, b* and rear indents 46*a, b* on the left and right sidewall outer channels 28*a, b* of lower container 100. Upper container 100' can now slide substantially freely backwards such that stacking feet channels 52*a'*-*d'* slide over left and right side wall rails 30*a, b* of lower container 100.

B. 180° Stacking

1. Stacking

Figure 15:
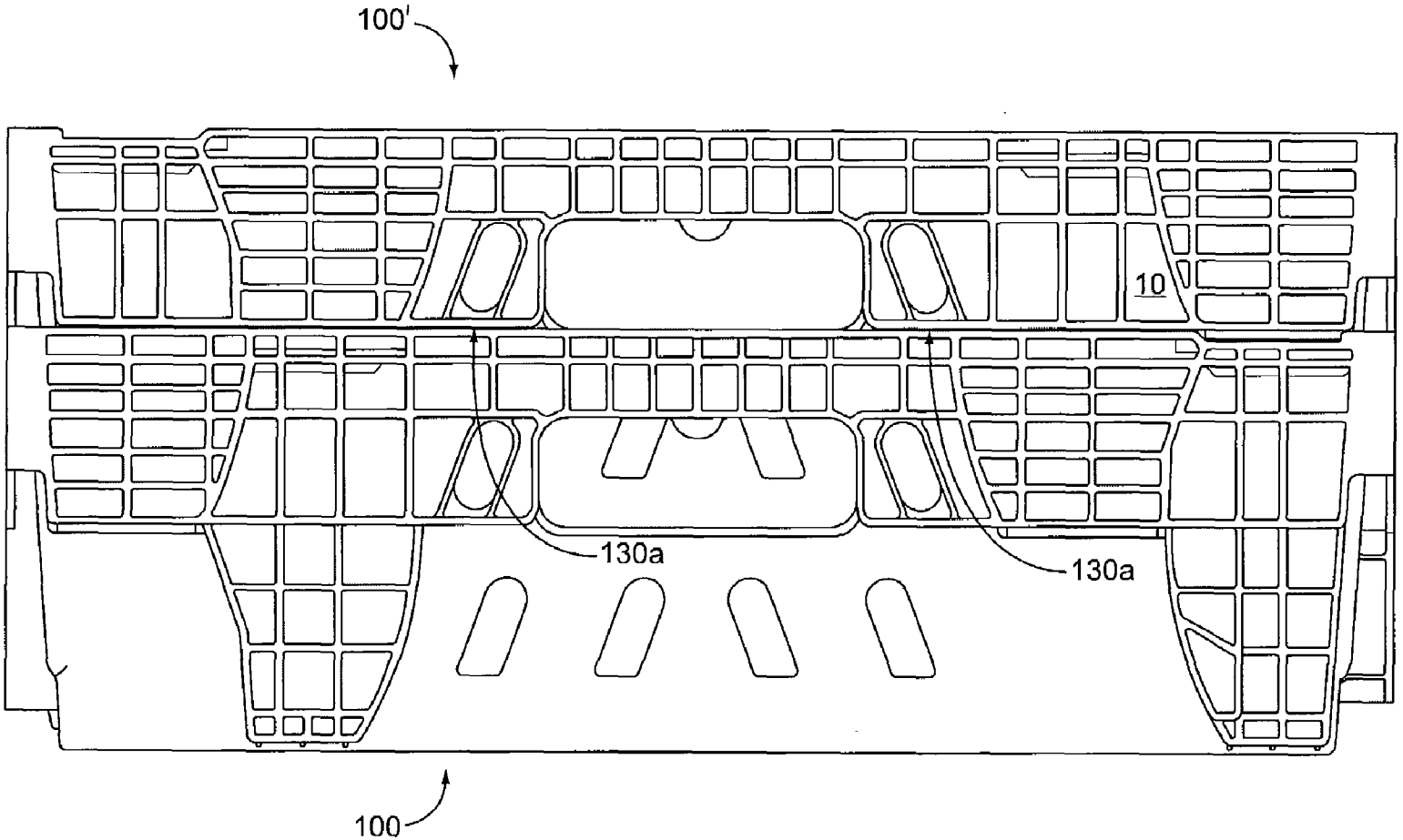
FIG. 15 illustrates a right side view of the two containers shown in FIG. 14.
Figure 16A:
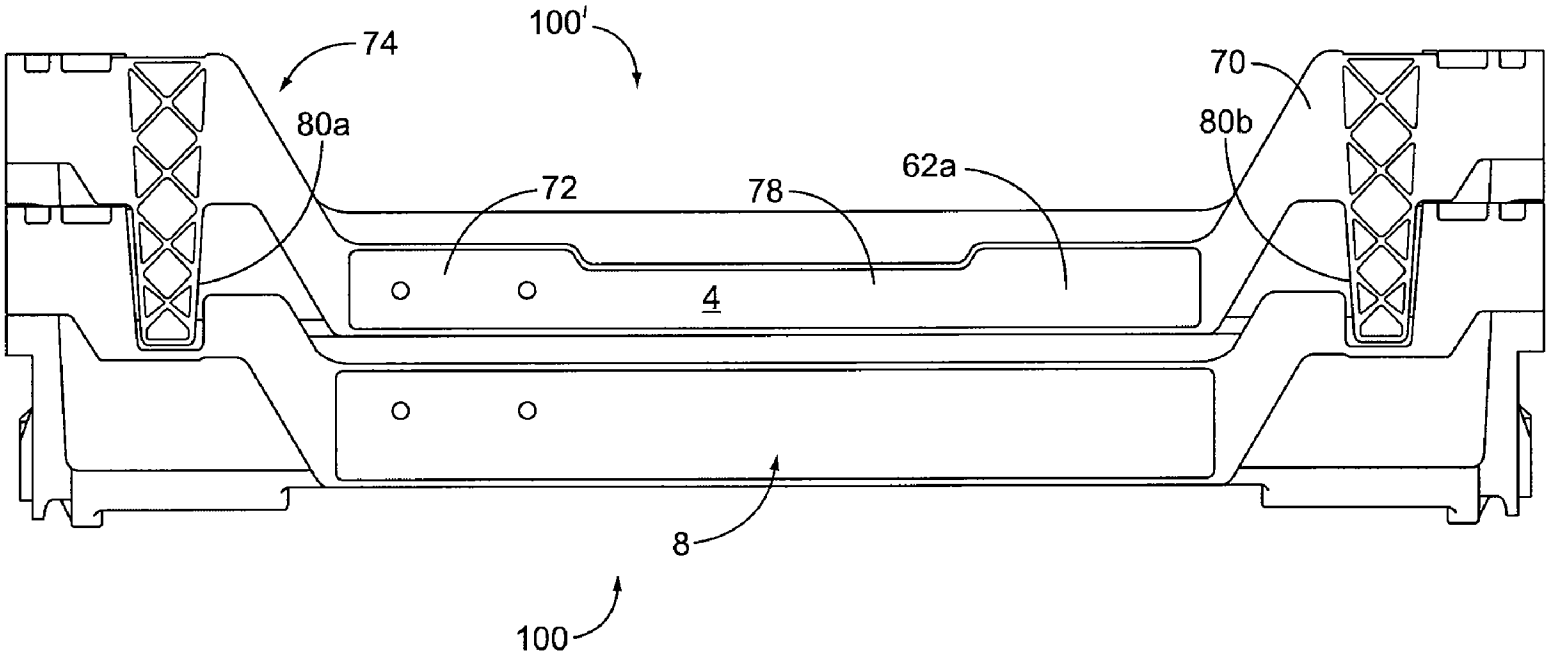
FIGS. 16A and 16B illustrate a rear view of the two containers shown in FIG. 14.
Figure 16B:
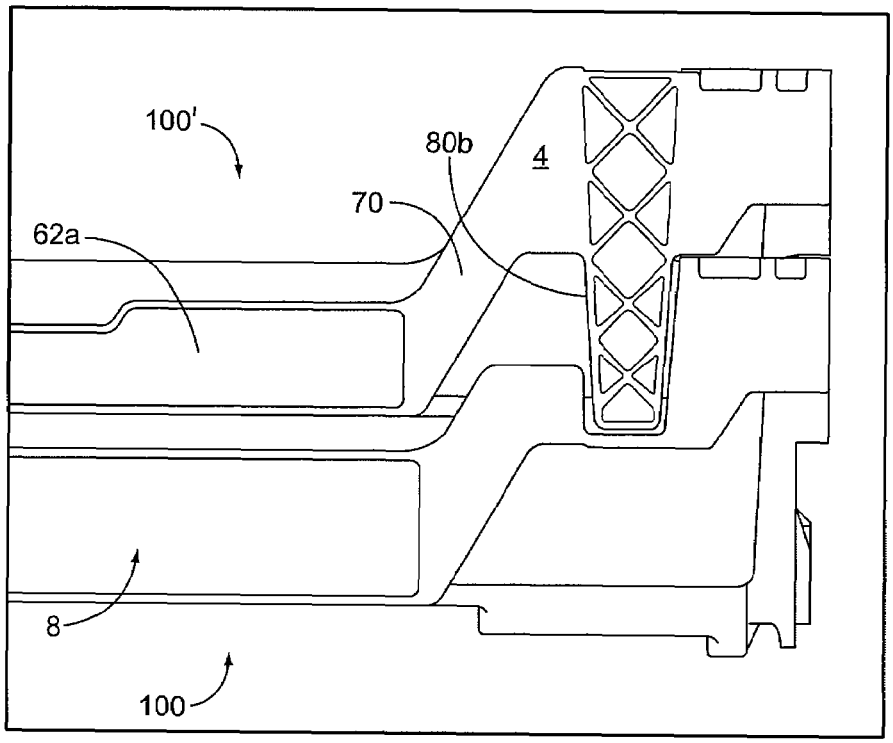
Figure 17:
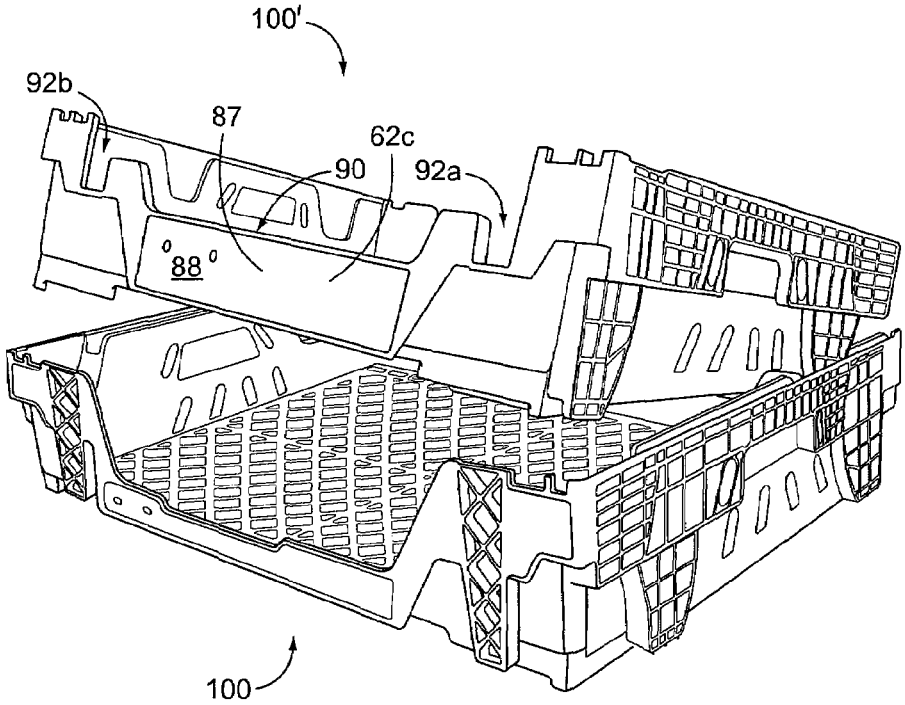
FIG. 17 illustrates a front isometric view of the two containers shown in FIG. 14.
Figure 18:
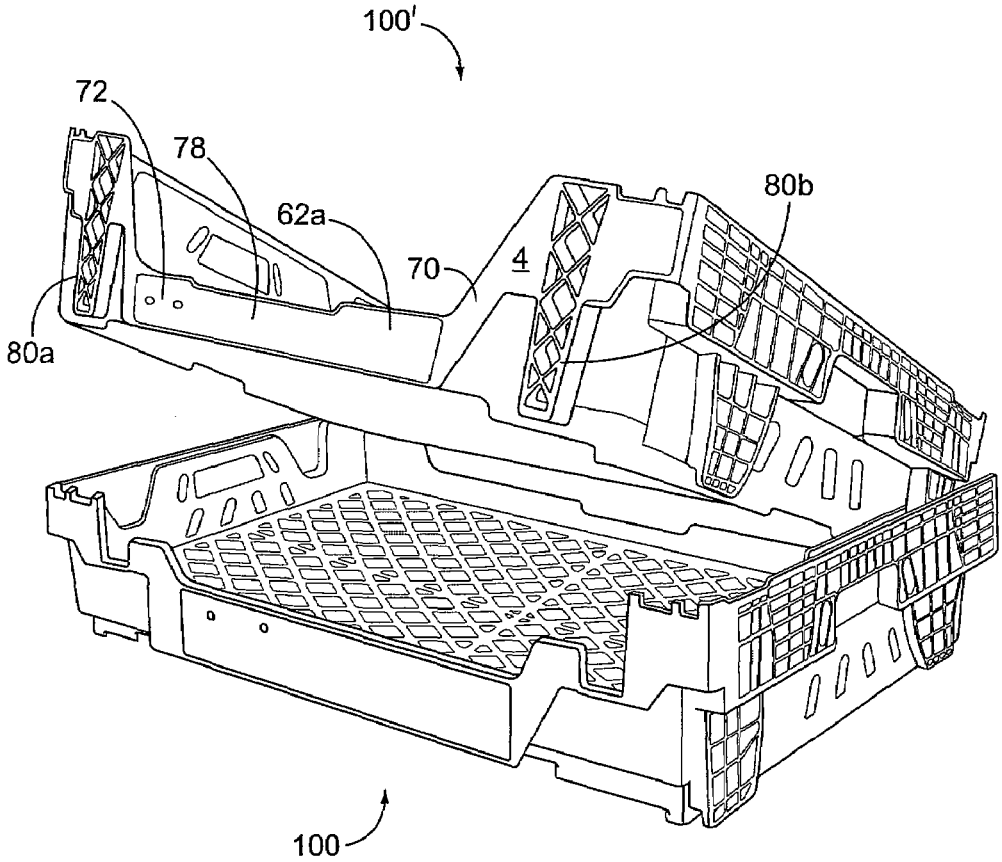
FIG. 18 illustrates a rear isometric view of the two containers shown in FIG. 14.

FIGS. 14-18 illustrate upper container 100' in a 180° stacking configuration with respect to lower container 100 from several different perspectives. FIG. 14 illustrates a front view of two containers shown in FIG. 1 shown in a 180° stacking configuration according to an exemplary embodiment of the present invention. FIG. 15 illustrates a right side view of the two containers shown in FIG. 14, FIGS. 16A and 16B illustrate a rear view of the two containers shown in FIG. 14, FIG. 17 illustrates a front isometric view of the two containers shown in FIG. 14, and FIG. 18 illustrates a rear isometric view of the two containers shown in FIG. 14. As will be discussed in greater detail below, when container 100' and 100 are stacked in a 180° stacking configuration, the containers can contain baked product, but generally do not. As those of ordinary skill in the art of the present invention can appreciate, the 180° stacking configuration is generally used to stack empty containers 100 until they are needed to transport baked product. Therefore, efficient use of space is of great interest, as well as the ease of removing an upper container 100' from a lower container 100 so that baked product can then be placed in the container 100. Since there is no way of predicting from which direction the user will retrieve an upper container 100' from a lower container 100 (i.e., from the front or rear of upper container 100'), the container incorporates unique features to facilitate removal of an upper container 100' from a lower container 100 in a 180° stacking configuration with as little difficulty as possible. Such features will be described in great detail below. In regard to the efficient utilization of space, when containers 100 are in a 0° stacking configuration, the height of two containers 100', 100 is about 11⅝ inches (or 296 mm). In the 180° stacking configuration, the height of two containers 100' 100 is about 9 inches (or 228 mm). Thus, there is a reduction of about 23% in the height of the 180° stacked containers 100', 100. Therefore, users can fit about thirteen 180° stacked containers in the space of ten 0° stacked containers, which is a significant savings in space required for empty containers 100.

In the 180° stacking configuration, left front stacking feet 38*a'* of upper container 100' is inserted into right rear 180° stacking receptacle 66*b* of lower container 100, left rear stacking feet 108*a'* is inserted into right front 180° stacking receptacle 64*b*, right front stacking feet 38*b'* is inserted into left rear 180° stacking receptacle 66*a*, and right rear stacking feet 108*b'* is inserted into left front 180° stacking receptacle 64*a*. Left front stacking feet curved surface 54*a'* of left front stacking feet 38*a'* substantially corresponds to right rear 180° stacking receptacle curved surface 124*b* of right rear 180° stacking receptacle 66*b*, and left front stacking feet angled surface 56*a'* of left front stacking feet 38*a'* substantially corresponds to right rear 180° stacking receptacle angled surface 126*b*. Also, left rear stacking feet curved surface 58*a'* of left rear stacking feet 108*a'* substantially corresponds to right front stacking receptacle curved surface 67*b* of lower container 100. Further still, in the 180° stacking configuration, left and right upper wall portion rails 130*a'*, *b'* of upper container 100' rest upon right, left side top outer rail 26*b*, a of lower container 100.

As discussed above in regard to the 0° stacking configuration, when stacking an upper container 100' onto a lower container 100, the user can simply place upper container 100' directly into the 180° stacking configuration position, or, can place either front wall 4 or rear wall 8 onto an interior portion of lower container 100 and slide upper container 100' into the 180° stacking configuration. For example, if the user places front wall 4' of upper container 100' onto the middle of lower container 100, stacking feet channel 52*b'* of left front stacking feet 38*b'* of upper container 100' rests over right side top inner rail 30*a* of lower container 100, and stacking feet channel 52*a'* of left front stacking feet 38*a'* of upper container 100' rests over right side top inner rail 30*b* of lower container 100. Also, stacking feet wall 50*b'* of right front stacking feet 38*b'* of upper container 100' sits within right side wall outer channel 28*a* of lower container 100, and stacking feet wall 50*a'* of left front stacking feet 38*a'* of upper container 100' sits within right side wall outer channel 28*b* of lower container 100. Right lower rail 60*b'* of upper container 100' rests within left front wall inner channel 32*a* of lower container 100, and left lower rail 60*a'* of upper container 100' rests within right front wall inner channel 32*b* of lower container 100. When the user slides upper container 100' backwards (i.e., away from front wall 4 of lower container 100), left, right lower rail 60*a'*, *b'* of upper container 100' slides through right, left front wall inner channel 32*b*, a, respectively, of lower container 100 until the 180° stacking configuration position is reached, and the front and rear stacking feet on both the left and right sides fall into their respective receptacles, as discussed in detail above.

Alternatively, if the user places rear wall 8' of upper container 100' onto the middle of lower container 100, stacking feet channel 52*c'* of right rear stacking feet 108*b'* of upper container 100' rests over left side top inner rail 30*a* of lower container 100, and stacking feet channel 52*d'* of left rear stacking feet 108*a'* of upper container 100 rests over right side top inner rail 30*b* of lower container 100. Also, stacking feet wall 50*c'* of right rear stacking feet 108*b'* of upper container 100' sits within left side wall outer channel 28*a* of lower container 100 and stacking feet wall 50*d'* of left rear stacking feet 108*a'* of upper container 100' sits within right side wall outer channel 28*b* of lower container 100. Substantially glossy free area 60*b'* of upper container 100' rests within left rear wall inner channel 33*a* of lower container 100, and left lower rail 60*a'* of upper container 100' rests within right rear wall inner channel 33*b* of lower container 100. When the user slides upper container 100 frontwards (i.e., towards front wall 4 of lower container 100), left, right lower rail 60*a'*, *b'* of upper container 100' slides through right, left rear wall inner channel 33*b*, a, respectively, of lower container 100 until the 180° stacking configuration position is reached, and the front and rear stacking feet on both the left and right sides fall into their respective receptacles, as discussed in detail above.

2. Un-Stacking

To un-stack upper container 100' from lower container 100, the user can, of course, simply lift upper container 100' substantially up and away from lower container 100. However, the majority of the time, this will not be the case, and the user will either grasp rear wall 8' of upper container 100' that is over front wall 4 of lower container 100, or grasp front wall 4' of upper container 100' that is over rear wall 8 of lower container 100. The former situation shall be discussed first, then the latter.

In the first instance, to un-stack upper container 100' from lower container 100 when in the 180° stacking configuration, the user first grasps rear wall 8' and lifts up. As the user lifts rear wall 8', upper container 100' rotates about right front stacking feet angled surface 56*b*' of right front stacking feet 38*b*', which is in contact with left rear 180° stacking receptacle angled surface 126*a* of left rear 180° stacking receptacle 66*a* of lower container 100, and right front stacking feet curved surface 54*b*' of right front stacking feet 38*b*' slides against left rear 180° stacking receptacle curved surface 124*a*, also of left rear 180° stacking receptacle 66*a* of lower container 100. The same rotation and sliding occurs on the other side of the containers 100', 100. Left rear 180° stacking receptacle curved surface 124*a* of lower container 100, as discussed above, substantially matches right front stacking feet curved surface 54*b*' of upper container 100' in terms of width and radius of curvature. Right rear 180° stacking receptacle curved surface 124*b* of lower container 100, as discussed above, substantially matches left front stacking feet curved surface 54*a*' of upper container 100' in terms of width and radius of curvature. Right front stacking feet angled surface 56*b*' of upper container 100', as discussed above, substantially matches left rear 180° stacking receptacle angled surface 126*a* in terms of width and angled surfaces. Left front stacking feet angled surface 56*a*' of upper container 100', as discussed above, substantially matches right rear 180° stacking receptacle angled surface 126*b* of lower container 100 in terms of width and angled surfaces.

Left rear 180° stacking receptacle angled surface 126*a* and right rear 180° stacking receptacle angled surface 126*b* include two angled surfaces: a lower angled surface and an upper angled surface. Left rear 180° stacking receptacle angled surface 126*a* includes lower angled surface 116*a* and 118*a* (as shown in FIG. 1), and right rear 180° stacking receptacle angled surface 126*b* includes lower angled surface 116*b* and 118*b*. The lower angled surface 116*a, b* for both left, right rear 180° stacking receptacles is formed between about a 3° and 5° angle from the horizontal according to an exemplary embodiment of the present invention. According to a preferred embodiment of the present invention, lower angled surfaces 116*a, b*, is formed at angled of about 5° from the horizontal. According to an exemplary embodiment of the present invention, upper angled surfaces 118*a, b* for both left, right rear 180° angled surface 126*a, b* is formed between an angle of about 9° to about an angle of 11° from the horizontal. According to a preferred embodiment of the present invention, upper angled surfaces 118*a, b* are formed at an angle of about 10° from the horizontal. The lower and upper angled surfaces 116*a, b* and 118*a, b* of left, right rear 180° angled surfaces 126*a, b* are configured to substantially prevent or alleviate binding when an upper container 100' is lifted off from lower container 100 in the 180° stacking configuration.

Because right, left front stacking feet angled surface 56*b'*, *a*' of upper container 100' and left, right rear 180° stacking receptacle angled surface 126*a, b* of lower container 100 have substantially identical angled surfaces and widths, the user will be able to rotate upper container 100' substantially easier than if that was not the case. Further, because right, left front stacking feet curved surface 54*b'*, *a*' of upper container 100' and left, right rear 180° stacking receptacle curved surface 124*a, b* of lower container 100 have substantially identical dimensions and radii of curvature, users will be able to more easily lift and rotate upper container 100' up from lower container 100.

Following rotation, the user then continues to lift upper container 100' until stacking feet wall 50*b*' of upper container 100' clears left side wall outer channel 28*a* of lower container 100, and stacking feet wall 50*a*' of upper container 100' clears right side wall outer channel 28*b* of lower container 100. The user can then pull upper container 100' forward, as stacking feet wall 50*b'*, *a*' slide forward on left, right side wall outer channel 28*a, b*, respectively, and right, left lower rail 60*b'*, *a*' slide forward through right, left front wall inner channel 32*b*, a, respectively, of lower container 100.

In the second instance, to un-stack upper container 100' from lower container 100 when in the 180° stacking configuration, the user first grasps front wall 4' and lifts up. As the user lifts front wall 4', upper container 100' rotates about left and right rear stacking feet 108*a'*, *b*' of upper container 100' within right and left front 180° stacking receptacles 64*b*, a of lower container 100. Left rear stacking feet curved surface 58*a*' of left rear stacking feet 108*a*', which is in contact with right front stacking receptacle curved surface 67*b* of right front 180° stacking receptacle 64*b* of lower container 100, and right rear stacking feet curved surface 58*b*' of right rear stacking feet 108*b*', which is in contact with left front stacking receptacle curved surface 67*a* of left front 180° stacking receptacle 64*a* of lower container 100, slides against right, left front stacking receptacle curved surface 67*b*, a respectively, of lower container 100. Right front stacking receptacle curved surface 67*b*, of lower container 100 as discussed above, substantially matches left rear stacking feet curved surface 58*a*' of upper container 100' in terms of width and radius of curvature. Left front stacking receptacle curved surface 67*a* of lower container 100, as discussed above, substantially matches right rear stacking feet curved surface 58*b*' of upper container 100' in terms of width and radius of curvature.

Because right, left rear stacking feet curved surface 58*b'*, *a*' of upper container 100' and left, right front stacking receptacle curved surfaces 67*a, b* of lower container 100 have substantially identical dimensions and radii of curvature, users will be able to more easily lift and rotate upper container 100' up from lower container 100. Following rotation, the user then continues to lift upper container 100' until stacking feet wall 50*d*' clears right side wall outer channel 28*b* of lower container 100, and stacking feet wall 50*c*' of upper container 100' clears left side wall outer channel 28*a* of lower container 100. The user can then pull upper container 100' forward, as stacking feet wall 50*a*'-*d*' slide forward on left, right side wall outer channel 28*a, b*, and left, right lower rail 60*a'*, *b*' slides forward through right, left rear wall inner channel 33*b*, a, respectively, of lower container 100.

Figure 19:
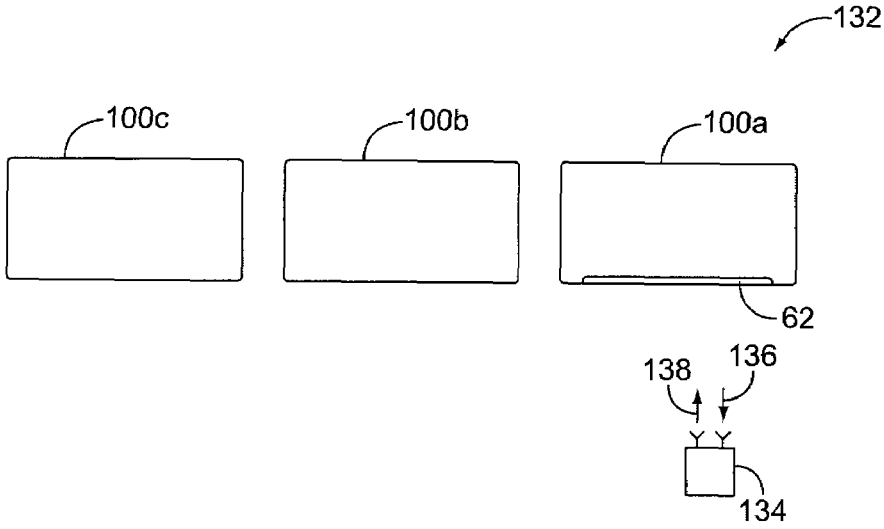
FIG. 19 illustrates a block diagram of a photo-detection system for counting containers according to an exemplary embodiment of the present invention.

FIG. 19 illustrates a block diagram of a photo-detection system for counting containers according to an exemplary embodiment of the present invention. Containers 100A, B, C move along conveyor 132 before or after washing by an automated washing system (not shown). As part of the washing process, each container 100 is counted by an automated counting system 134, according to an exemplary embodiment of the present invention, a photo-detector system. Photo-detector system (system) 134 transmits a light beam, preferably a laser, from transmitter 136 and when the light beam is returned because it is reflected off container 100, system 134 increments a count of containers. However, as described above, containers 100 contain several ventilation holes, and have a significantly glossy surface. Therefore it can happen that several reflections from one container could be misinterpreted as several different containers 100. To substantially prevent mis-counting from occurring, container 100 contains substantially glossy free areas 62*b, d* on right side wall 6 and left side wall 10 respectively. Substantially glossy free areas 62*b, d* prevent transmitted light from system 134 from reflecting back to receiver 138; instead, the transmitted light beam is scattered back in many different directions, and the amount of light that might be reflected back towards receiver 138 is significantly reduced so that receiver 138 cannot adequately detect the reflected signal. As a result, mis-counts of containers 100 are substantially prevented. Furthermore, container 100 can include substantially glossy free areas 62*e* that includes all the substantially smooth surface areas on the interior of container 100, and substantially glossy free areas 62*f*, which are all the substantially smooth areas on lower surface 14 of base 2.

The glossy free areas 62*a-d*, as briefly described above, may comprise a plurality of micro-bumps, diamond etching, recesses, ribs, grooves, and various other types of markings, indentations and other alterations (micro-bumps) 102 of the surface. FIGS. 1-7 show where gloss free areas 62*a-e* are located, and FIG. 8 shows where glossy free area 62*f* is located.

Micro-bumps 102 are raised or depressed areas on various surfaces of container 100 that can also assist in preventing commonly used stickers from adhering permanently to the surfaces of container 100, as one of ordinary skill in the art can appreciate. These stickers can indicate, for example, the time and date of processing, the type of product, the source of the product, the plant that baked and/or packed the product, and other such information that might be necessary. Once the product is retrieved from container 100, the stickers are no longer pertinent, and must be removed. Micro-bumps 102 make such removal much easier, because there is less surface area of container 100 for the sticker to adhere to. Because of micro-bumps 102, only 30-40% of the sticker surface area adheres to container 100. On a substantially flat container surface, however, close to 100% of the surface area of the sticker adheres to the substantially flat container surface.

Figure 20A:
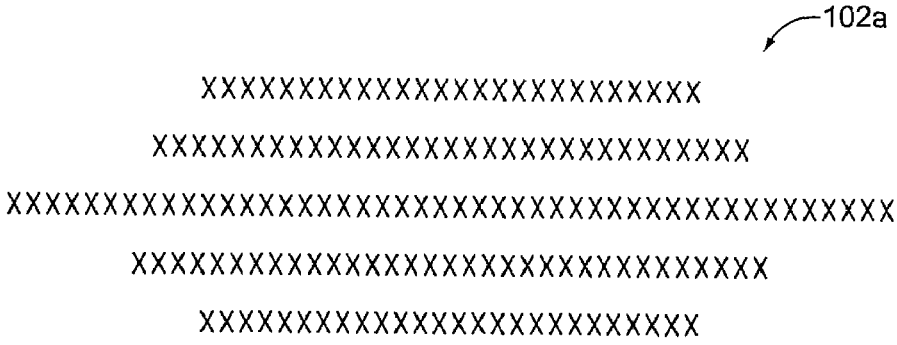
FIGS. 20A-20F illustrate a plurality of designs for micro-bumps used on the containers shown in FIGS. 1 through 19 according to an embodiment of the present invention.
Figure 20B:
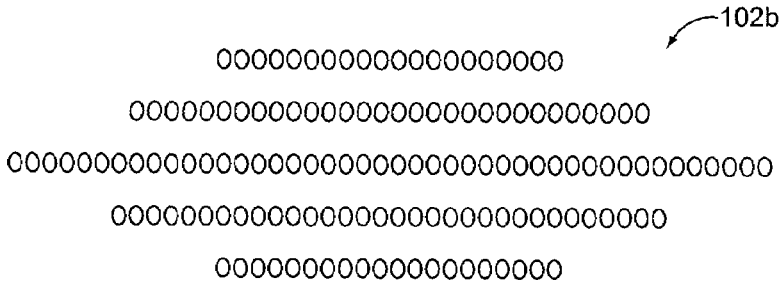
Figure 20C:
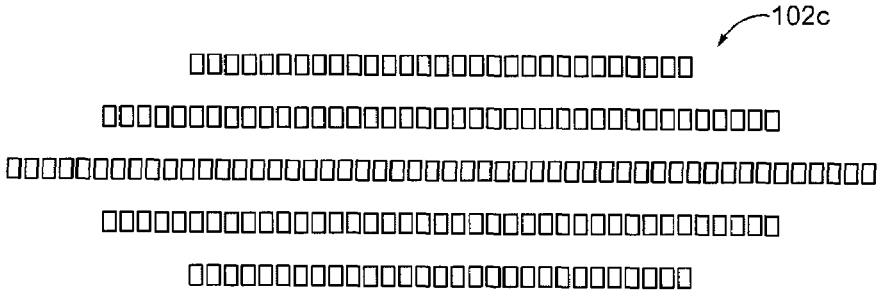
Figure 20D:
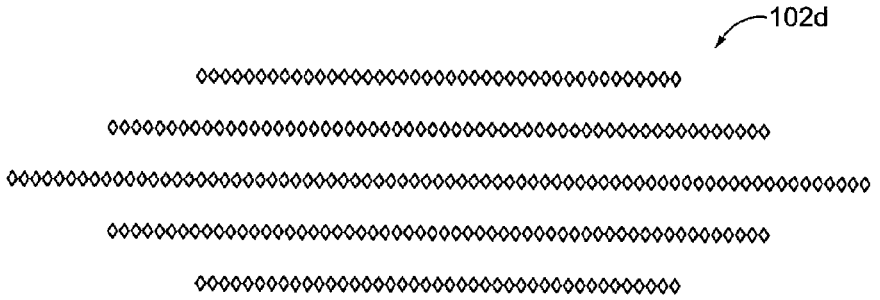
Figure 20E:
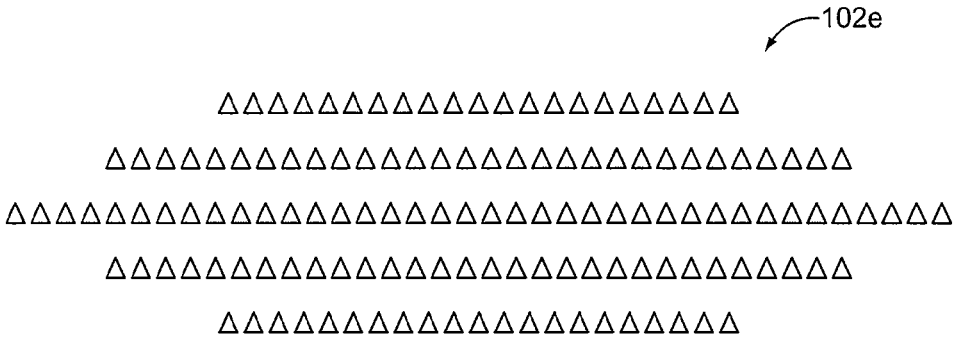
Figure 20F:
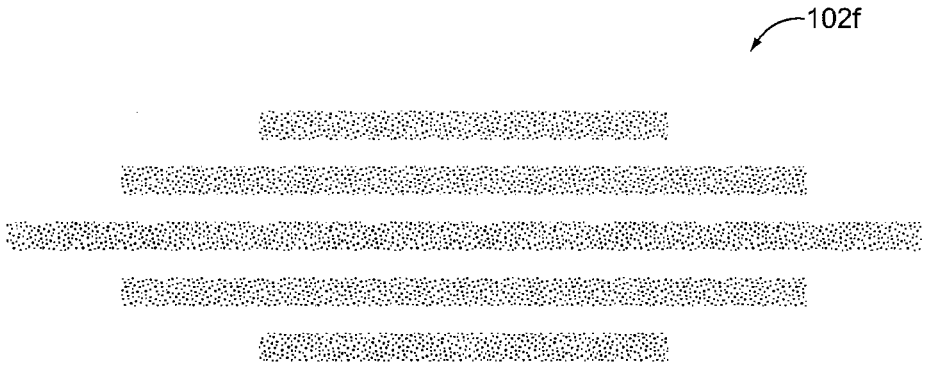

Examples of different types of micro-bumps 102 are shown in FIGS. 20A-F. Micro-bumps 102 can be in almost any imaginable shape, though, as FIGS. 20A-F illustrate, there are more common designs prevalent throughout the industry. As shown in FIG. 20A, micro-bumps 102*a* are in the form of an "X"; in FIG. 20B, micro-bumps 102*a* are in the form of and circles ○; in FIG. 20C, micro-bumps 102*a* are in the form of a box □; in FIG. 20D, micro-bumps 102*d* are in the form of a diamond ◇; in FIG. 20E, micro-bumps 102*e* are in the form of a triangle ▲; and in FIG. 20F, micro-bumps 102*f* are in the form of dots ⁘. According to another embodiment of the present invention, the micro-bumps 102 can be in the shape of alternating grooves or ridges that can be curved (elliptical, circular, oval, "s" shaped, among others) or substantially straight.

As FIGS. 1-8 indicate, there are several areas, though not the only ones, that micro-bumps 102 can be located. These areas are referred to as glossy free areas 62*a-f*. Referring to FIGS. 1-7, glossy free area 62*a* is preferably located on an exterior surface of front wall 4, and glossy free area 62*b* is preferably located on an outer surface 22 of right side wall 6. Glossy free area 62*c* is preferably located on an outer surface of rear wall 8, and glossy free area 62*d* is preferably located on an outer surface of left side wall 10. Glossy free area 62*e* is preferably located on any substantially smooth interior surface of container 100, and glossy free area 62*f* is preferably located on any substantially smooth exterior surface of base 2.

The present invention has been described with reference to certain exemplary embodiments thereof. However, it will be readily apparent to those skilled in the art that it is possible to embody the invention in specific forms other than those of the exemplary embodiments described above. This may be done without departing from the spirit and scope of the invention. The exemplary embodiments are merely illustrative and should not be considered restrictive in any way. The scope of the invention is defined by the appended claims and their equivalents, rather than by the preceding description.

All United States patents and applications, foreign patents, and publications discussed above are hereby incorporated herein by reference in their entireties.

What is claimed is:

1. A container for carrying product, wherein a second upper identical container can be stacked in a 0° and a 180° stacking configuration on a first lower container, the container comprising:

a base; and a front wall, rear wall, left side wall, and right side wall, the walls substantially orthogonal and joined to each other, and substantially perpendicular to and joined to the base; wherein the right side wall includes a right side wall front stacking foot, and a right side wall rear stacking foot, wherein the right side wall front stacking foot includes a first curved surface on a rearward facing portion of said front side wall front stacking foot, and further includes a first angled and second angled surface on a frontward facing portion of said front side wall front stacking foot opposite the first curved surface on the rearward facing portion, and wherein the right side wall rear stacking foot includes a second curved surface on a frontward facing portion of said right side wall rear stacking foot, and wherein, the left side wall includes a left side wall front stacking foot and a left side wall rear stacking foot, wherein the left side wall front stacking foot includes a third curved surface on a rearward facing portion of said left side wall front stacking foot, and further includes a third and fourth angled surface on a frontward facing portion of said left side wall front stacking foot opposite the third curved surface on the rearward facing portion, and wherein the left side wall rear stacking foot includes a fourth curved surface on a frontward facing portion of said left side wall rear stacking foot, and wherein, the right side wall further includes a right side wall front 180° stacking receptacle and a right side wall rear 180° stacking receptacle, wherein the right side wall front 180° stacking receptacle includes, a fifth curved surface, and the right side wall rear 180° stacking receptacle includes, a sixth curved surface and a fifth and sixth angled surface, and the left side wall also includes a left side wall front 180° stacking receptacle and a left side wall rear 180° stacking receptacle, wherein the left side wall front 180° stacking receptacle includes, a seventh curved surface, and the left side wall rear 180° stacking receptacle includes, a eighth curved surface and a seventh and eighth angled surface, and further wherein, in a stacked relationship, the right side wall front 180° stacking receptacle and the left side wall front 180° stacking receptacle of a first lower container are configured to accept the left side wall rear stacking foot and the right side wall rear stacking foot respectively of a second upper container, when the second upper container is stacked in a 180° stacking configuration with respect to the first lower container, and the right side wall rear 180° stacking receptacle and the left side wall rear 180° stacking receptacle of the first lower container are configured to accept the left side wall front stacking foot and the right side wall front stacking foot respectively of the second upper container, when the second upper container is stacked in a 180° stacking configuration with respect to the first lower container, and wherein, the first and second containers are configured such that when the second upper container is removed from the first lower container after being stacked in the 180° stacking configuration, the second curved surface of said right side wall rear stacking foot and the fourth curved surface of said left side wall rear stacking foot of the second upper container slidingly engages and rotates in a substantially smooth rotational manner with the substantially similarly seventh curved surface of said left side wall front 180° stacking receptacle and the substantially similarly fifth curved surface of said right side wall front 180° stacking receptacle of the first lower container, respectively, when the second upper container is lifted by its front wall, and the first curved surface of said right side wall front stacking foot and the third curved surface of said left side wall front stacking foot of the second upper container slidingly engages and rotates in a substantially smooth rotational manner with the substantially similarly eighth curved surface of said left side wall rear 180° stacking receptacle and the substantially similarly sixth curved surface of said right side wall rear 180° stacking receptacle of the first lower container, respectively, when the second upper container is lifted by its rear wall.

2. The container according to claim 1, wherein each of the first, second, third, and fourth curved surfaces of the stacking feet of the left and right sidewalls comprises:

a plurality of angled surfaces such that the plurality of angled surface approximates that of a substantially smooth curved surface.

3. The container according to claim 1, wherein each of the first, third, fifth and seventh angled surfaces comprises:

an angled surface formed at an angle between about 9° and about 11°.

4. The container according to claim 1, wherein each of the first, third, fifth and seventh angled surfaces comprises:

an angled surface formed at an angle at about 10°.

5. The container according to claim 1, wherein each of the second, fourth, sixth and eighth angled surfaces comprises:

an angled surface formed at an angle between about 3° and about 5°.

6. The container according to claim 1, wherein each of the second, fourth, sixth and eighth angled surfaces comprises:

an angled surface formed at an angle at about 4°.

7. The container according to claim 1, wherein the first and second containers are configured such that when the second upper container is removed from the first lower container after being stacked in the 180° stacking configuration, the first and second angled surfaces of said right side wall front stacking foot are configured to slidingly engage and rotate about the substantially similarly seventh and eighth angled surfaces of said left side wall rear 180° stacking receptacle, and the third and fourth angled surfaces of said left side wall front stacking foot are configured to slidingly engage and rotate about the substantially similarly fifth and sixth angled surfaces of said right side wall rear 180° stacking receptacle, when the second upper container is lifted by its rear wall.

8. A container for carrying product, wherein a second upper identical container can be stacked in a 0° and a 180° stacking configuration on a first lower container, the containers comprising:

a base; and a front wall, rear wall, left side wall, and right side wall, the walls substantially orthogonal and joined to each other, and substantially perpendicular to and joined to the base, wherein the right side wall includes a right side wall front stacking foot, and a right side wall rear stacking foot, wherein the right side wall front stacking foot includes a first curved surface on a rearward facing portion of said front side wall front stacking foot, and further includes a first angled and second angled surface on a frontward facing portion of said front side wall front stacking foot opposite the first curved surface on the rearward facing portion, and wherein the right side wall rear stacking foot includes a second curved surface on a frontward facing portion of said right side wall rear stacking foot, and wherein, the left side wall includes a left side wall front stacking foot and a left side wall rear stacking foot, wherein the left side wall front stacking foot includes a third curved surface on a rearward facing portion of said left side wall front stacking foot, and further includes a third and fourth angled surface on a frontward facing portion of said left side wall front stacking foot a first curved surface on a rearward facing portion of said front side wall front stacking foot opposite the third curved surface on the rearward facing portion, and wherein the left side wall rear stacking foot includes a fourth curved surface on a frontward facing portion of said left side wall rear stacking foot, and wherein, the right side wall further includes a right side wall front 180° stacking receptacle and a right side wall rear 180° stacking receptacle, wherein the of the right side wall front 180° stacking receptacle includes, a fifth curved surface, and the of the right side wall rear 180° stacking receptacle includes, a sixth curved surface and a fifth and sixth angled surface, and the left side wall also includes a left side wall front 180° stacking receptacle and a left side wall rear 180° stacking receptacle, wherein the of the left side wall front 180° stacking receptacle includes, a seventh curved surface, and the of the left side wall rear 180° stacking receptacle includes, a eighth curved surface and a seventh and eighth angled surface, and further wherein, the right side wall front 180° stacking receptacle and the left side wall front 180° stacking receptacle of a first lower container are configured to accept the left side wall rear stacking foot and the right side wall rear stacking foot respectively of a second upper container, when the second upper container is stacked in a 180° stacking configuration with respect to a first lower container, and the right side wall rear 180° stacking receptacle and the left side wall rear 180° stacking receptacle of the first lower container are configured to accept the left side wall front stacking foot and the right side wall front stacking foot respectively of the second upper container, when the second upper container is stacked in a 180° stacking configuration with respect to a first lower container, and wherein, the first and second containers are configured such that when the second upper container is removed from the first lower container after being stacked in the 180° stacking configuration, the first and second angled surfaces of said right side wall front stacking foot are configured to slidingly engage and rotate about the substantially similarly seventh and eighth angled surfaces of said left side wall rear 180° stacking receptacle, and the third and fourth angled surfaces of said left side wall front stacking foot are configured to slidingly engage and rotate about the substantially similarly fifth and sixth angled surfaces of said right side wall rear 180° stacking receptacle, when the second upper container is lifted by its rear wall.

9. The container according to claim 8, wherein each of the first, second, third, and fourth curved surfaces of the stacking feet of the left and right sidewalls comprises:

a plurality of angled surfaces such that the plurality of angled surface approximates that of a substantially smooth curved surface.

10. The container according to claim 8, wherein each of the first, third, fifth and seventh angled surfaces comprises:

an angled surface formed at an angle between about 9° and about 11°.

11. The container according to claim 8, wherein each the first, third, fifth and seventh angled surface comprises:

an angled surface formed at an angle at about 10°.

12. The container according to claim 8, wherein each of the second, fourth, sixth and eighth angled surfaces comprises:

an angled surface formed at an angle between about 3° and about 5°.

13. The container according to claim 8, wherein the second, fourth, sixth and eighth surfaces comprises:

an angled surface formed at an angle at about 4°.

14. The container according to claim 8, wherein the first and second containers are configured such that when the second upper container is removed from the first lower container after being stacked in the 180° stacking configuration, the second curved surface of said right side wall rear stacking foot and the fourth curved surface of said left side wall rear stacking foot of the second upper container slidingly engages and rotates in a substantially smooth rotational manner with the substantially similarly seventh curved surface of said left side wall front 180° stacking receptacle and the substantially similarly fifth curved surface of said right side wall front 180° stacking receptacle of the first lower container, respectively, when the second upper container is lifted by its front wall, and the first curved surface of said right side wall front stacking foot and the third curved surface of said left side wall front stacking foot of the second upper container slidingly engages and rotates in a substantially smooth rotational manner with the substantially similarly eighth curved surface of said left side wall rear 180° stacking receptacle and the substantially similarly sixth curved surface of said right side wall rear 180° stacking receptacle of the first lower container, respectively, when the second upper container is lifted by its rear wall.

15. A container, comprising:

a base;

a front wall including (i) a front wall interior surface, (ii) a front wall exterior surface, and (iii) left and right inner channels located at an upper portion of the front wall, and inward from the left and right side walls respectively;

a rear wall including (i) a rear wall interior surface, (ii) a rear wall exterior surface, and (iii) left and right inner channels located at an upper portion of the rear wall, and inward from the left and right side walls respectively; and a pair of opposing left and right side walls, each of the pair of opposing left and right side walls including (i) a side wall top portion, (ii) a side wall interior surface, (iii) a side wall exterior surface, (iv) an outer rail located on the side wall top portion, (v) an outer channel located on the side wall top portion and adjacent to, and inward from, the outer rail, (vi) front and rear stacking feet, wherein each of the rear stacking feet further includes a projection projecting horizontally outwardly from the rear stacking feet at a lower portion thereof, and (vii) a lower rail, wherein, the container is configured such that, when a substantially similar second upper container is placed on top of a first lower container such that the front wall of the first lower container and the front wall of the second upper container face in the same direction, and the second upper container slides backwards with respect to the first lower container, or the first lower container slides frontwards with respect to the second upper container, the projection on the rear stacking feet of both the left and right side walls of the second upper container is configured to support the second upper container on the outer rails of the left and right side walls of the first lower container, and the lower rails of the left and right side walls of the second upper container are configured to slidingly engage within the left and right inner channels of the first lower container, thereby substantially preventing any lateral movement of the second upper container with respect to the first lower container and to support the weight of the second upper containers on the first lower container.

16. The container according to claim 15, further comprising:

a left side wall outer rail indent portion; and a right side wall outer rail indent portion, wherein, the left side wall outer rail indent portion is configured to receive and secure a lower surface portion of the left rear stacking foot, and the right side wall outer rail indent portion is configured to receive and secure a lower surface portion of the right rear stacking foot, such that either or both the left side all outer rail indent portion and the right side wall outer rail indent portion substantially prevents or inhibits frontwards, backwards, and/or lateral motion of an upper stacked container.

17. The container according to claim 15 further comprising:

a right side wall top inner rail;

a left side wall top inner rail;

a right side wall front stacking foot wall portion located at a bottommost portion of the right side wall front stacking foot;

a right side wall rear stacking foot wall portion located at a bottommost portion of the right side wall front stacking foot;

a left side wall front stacking foot wall portion located at a bottommost portion of the right side wall front stacking foot;

a left side wall rear stacking foot wall portion located at a bottommost portion of the right side wall front stacking foot;

a right side wall front stacking foot channel formed between the right side wall front stacking foot wall portion and the right side wall;

a right side wall rear stacking foot channel formed between the right side wall rear stacking foot wall portion and the right side wall;

a left side wall front stacking foot channel formed between the left side wall front stacking foot wall portion and the left side wall; and a left side wall rear stacking foot channel formed between the left side wall rear stacking foot wall portion and the left side wall, wherein, when an upper container is stacked on a lower container in a 0° stacking configuration, the left side wall front stacking foot channel and the left side wall rear stacking foot channel, and the right side wall front stacking foot channel and the right side wall rear stacking foot channel are configured to substantially smoothly engage the left side wall top inner rail and right side wall top inner rail, respectively, such that the upper container slides substantially smoothly and freely frontwardly and backwardly over the lower container, and when the upper container is stacked on a lower container in a 180° stacking configuration, the left side wall front stacking foot channel and the left side wall rear stacking foot channel, and the right side wall front stacking foot channel and the right side wall rear stacking foot channel are configured to substantially smoothly engage the right side wall top inner rail and left side wall top inner rail, respectively, such that the upper container slides substantially smoothly and freely frontwardly and backwardly over the lower container.

18. A container for carrying product, wherein a second upper identical container can be stacked in a 0° and a 180° stacking configuration on a first lower container, the container comprising:

a base; and a front wall, rear wall, left side wall, and right side wall, the walls substantially orthogonal and joined to each other, and substantially perpendicular to and joined to the base, wherein, the front wall includes (i) a front wall interior surface, (ii) a front wall exterior surface, and (iii) left and right inner channels located inward from the left and right side walls respectively, and wherein the rear wall includes (i) a rear wall interior surface, (ii) a rear wall exterior surface, and (iii) left and right inner channels located inward from the left and right side walls respectively, the right side wall includes a right side wall front stacking foot, a right side wall rear stacking foot, a right side wall top portion, a right side wall outer rail located on the right side wall top portion, a right side wall outer channel located on the right side wall top portion and adjacent to, and inward from, the right side wall outer rail, a right side wall lower rail, and wherein each right side wall front stacking foot includes a first curved surface on a rearward facing portion of said front side wall front stacking foot, and further includes a first angled and second angled surface on a frontward facing portion of said front side wall front stacking foot, and wherein the right side wall rear stacking foot includes a second curved surface on a frontward facing portion of said right side wall rear stacking foot, and a right side wall rear stacking foot projection projecting outwardly from the right side wall rear stacking foot at a lower portion thereof; and wherein, the left side wall includes a left side wall front stacking foot, a left side wall rear stacking foot, a left side wall top portion, a left side wall outer rail located on the left side wall top portion, a left side wall outer channel located on the left side wall top portion and adjacent to, and inward from, the left side wall outer rail, and a left side wall lower rail, wherein the left side wall front stacking foot includes a third curved surface on a rearward facing portion of said left side wall front stacking foot, and further includes a third and fourth angled surface on a frontward facing portion of said left side wall front stacking foot, and wherein the left side wall rear stacking foot includes a fourth curved surface on a frontward facing portion of said left side wall rear stacking foot, a left side wall rear stacking foot projection projecting outwardly from the left side wall rear stacking foot at a lower portion thereof, and wherein, the right side wall further includes a right side wall front 180° stacking receptacle and a right side wall rear 180° stacking receptacle, wherein the right side wall front 180° stacking receptacle includes, a fifth curved surface, and the right side wall rear 180° stacking receptacle includes, a sixth curved surface and a fifth and sixth angled surface, and the left side wall also includes a left side wall front 180° stacking receptacle and a left side wall rear 180° stacking receptacle, wherein the left side wall front 180° stacking receptacles includes, a seventh curved surface, and the left side wall rear 180° stacking receptacle includes, an eighth curved surface and a seventh and eighth angled surface, and further wherein, the right side wall front 180° stacking receptacle and the left side wall front 180° stacking receptacle of a first lower container are configured to accept the left side wall rear stacking foot and the right side wall rear stacking foot respectively of a second upper container, when the second upper container is stacked in a 180° stacking configuration with respect to the first lower container, and the right side wall rear 180° stacking receptacle and the left side wall rear 180° stacking receptacle of the first lower container are configured to accept the left side wall front stacking foot and the right side wall front stacking foot respectively of the second upper container, when the second upper container is stacked in a 180° stacking configuration with respect to a first lower container, and wherein, the first and second containers are configured such that when the second upper container is removed from the first lower container after being stacked in the 180° stacking configuration, the second curved surface of said right side wall rear stacking foot and the fourth curved surface of said left side wall rear stacking foot of the second upper container slidingly engages and rotates in a substantially smooth rotational manner with the substantially similarly seventh curved surface of said left side wall front 180° stacking receptacle and the substantially similarly fifth curved surface of said right side wall front 180° stacking receptacle of the first lower container, respectively, when the second upper container is lifted by its front wall, and the first curved surface of said right side wall front stacking foot and the third curved surface of said left side wall front stacking foot of the second upper container slidingly engages and rotates in a substantially smooth rotational manner with the substantially similarly eighth curved surface of said left side wall rear 180° stacking receptacle and the substantially similarly sixth curved surface of said right side wall rear 180° stacking receptacle of the first lower container, respectively, when the second upper container is lifted by its rear wall, and further wherein the first and second containers are configured such that when the second upper container is removed from the first lower container after being stacked in the 180° stacking configuration, the first and second angled surfaces of said right side wall front stacking foot are configured to slidingly engage and rotate about the substantially similarly seventh and eighth angled surfaces of said left side wall rear 180° stacking receptacle, and the third and fourth angled surfaces of said left side wall front stacking foot are configured to slidingly engage and rotate about the substantially similarly fifth and sixth angled surfaces of said right side wall rear 180° stacking receptacle, when the second upper container is lifted by its rear wall, and further wherein the container is configured such that, when a substantially similar second upper container is placed on top of a first lower container such that the front wall of the first lower container and the front wall of the second upper container face in the same direction, and the second upper container slides backwards with respect to the first lower container, or the first lower container slides frontwards with respect to the second upper container, the projection on the rear stacking feet of both the left and right side walls of the second upper container is configured to support the second upper container on the outer rails of the left and right side walls of the first lower container, and the lower rails of the left and right side walls of the second upper container are configured to slidingly engage within the left and right inner channels of the first lower container, thereby substantially preventing any lateral movement of the second upper container with respect to the first lower container and to support the weight of the second upper containers on the first lower container, and still further wherein, the front wall further includes a first substantially glossy free area located on the front wall exterior surface, the rear wall further includes a second substantially glossy free area located on the rear wall exterior surface, and the left and right side walls further include a third and fourth substantially glossy free areas on the left and right side walls configured to substantially prevent a counting machine from mistakenly counting a container more than once when the container is placed under observation of the counting machine, and the fourth and third substantially glossy free areas on the left and right side walls are further configured to disperse an optical signal transmitted by the counting machine thereby substantially preventing the counting machine from mistakenly counting a container more than once when the container is placed under observation of the counting machine.

19. The container according to claim 18 wherein the first, second, third and fourth substantially glossy free areas comprise one or more of a plurality of micro-bumps, recesses, diamond etchings, ribs, and grooves on the surfaces each of the respective front, rear, left side, and rear side walls.

* * * * *

UNITED STATES PATENT AND TRADEMARK OFFICE

CERTIFICATE OF CORRECTION

PATENT NO. : 7,686,167 B2
APPLICATION NO. : 11/610933
DATED : March 30, 2010
INVENTOR(S) : Edward L. Stahl It is certified that error appears in the above-identified patent and that said Letters Patent is hereby corrected as shown below:

In Column 27, Line 4, in Claim 8, delete "the of" that appears before "the right".

In Column 27, Line 7, in Claim 8, delete "the of" that appears before "the right".

In Column 27, Line 4, in Claim 8, delete "the of" that appears before "the right".

In Column 27, Line 4, in Claim 8, delete "the of" that appears before "the right".

In Column 27, Line 63, in Claim 11, after "each" insert --of--.

In Column 29, Line 25 (approximately), in Claim 16, delete "all" that appears after "side" and insert --wall-- therefor.

Signed and Sealed this

Twenty-second Day of June, 2010

David J. Kappos

David J. Kappos
*Director of the United States Patent and Trademark Office*